US006210049B1

(12) United States Patent
Yamada et al.

(10) Patent No.: US 6,210,049 B1
(45) Date of Patent: Apr. 3, 2001

(54) IMAGE FORMING APPARATUS AND FLUID INJECTING APPARATUS

(75) Inventors: Toshihiko Yamada; Kazuo Sanada; Tsutomu Takatsuka, all of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/220,358

(22) Filed: Dec. 24, 1998

Related U.S. Application Data

(63) Continuation-in-part of application No. 08/997,694, filed on Dec. 23, 1997, now Pat. No. 5,960,224.

(30) Foreign Application Priority Data

Dec. 26, 1996 (JP) ..... 8-349093
Mar. 4, 1997 (JP) ..... 9-49340
Dec. 25, 1997 (JP) ..... 9-356686

(51) Int. Cl.[7] ..... G03D 13/00
(52) U.S. Cl. ..... 396/575; 396/627; 396/604
(58) Field of Search ..... 396/575, 604, 396/607, 622, 627; 346/136

(56) References Cited

U.S. PATENT DOCUMENTS 4,721,968 * 1/1988 Arai et al. ..... 346/136
4,731,621 3/1988 Hayamizu et al. ..... 347/68
5,019,857 * 5/1991 Milovanovich ..... 396/622
5,574,530 11/1996 Sanada ..... 396/604
5,666,140 9/1997 Mitani et al. ..... 347/12
5,746,373 5/1998 Sanada ..... 239/102.2
5,808,647 9/1998 Kurata et al. ..... 347/104
5,896,154 * 4/1999 Mitani et al. ..... 347/102
6,010,254 * 1/2000 Sanada ..... 396/604

* cited by examiner

*Primary Examiner*—D. Rutledge
(74) *Attorney, Agent, or Firm*—Sughrue, Mion, Zinn, Macpeak & Seas, PLLC

(57) ABSTRACT

An image forming apparatus including an injector disposed opposite the transfer path of an image recording material and injecting an image forming solvent toward the image recording material, and a guide member having suction holes for suction, disposed opposite the injector with respect to the transfer path for the image recording material and guiding the image recording material by sucking through the sucking holes. Accordingly, since the guide member guides the image recording material by sucking through suction holes, a clearance between the injector and the image recording material is kept constant during injection of the image forming solvent, so that the image forming solvent can be applied to the image recording material uniformly.

19 Claims, 25 Drawing Sheets

314
312A
352
312D
320
314
312A
352
320
312D 320
354
352
312A
314
320
352
312A
314

314
354
352
320
356
322
320
352

IMAGE FORMING APPARATUS AND FLUID INJECTING APPARATUS

This is a Continuation-in-Part of Application Ser. No. 08/997,694 filed Dec. 23, 1997, now U.S. Pat No. 5,960,224 which is hereby incorporated by reference.

BACKGROUND OF THE INVENTION

1. Field of the Invention

The present invention relates to an image forming apparatus and a fluid injecting apparatus which can suitably inject a solvent for forming an image to an image recording material such as a photosensitive material, an image receiving material and the like.

2. Description of the Related Art

An image forming apparatus for performing an image recording operation by using two kinds of image recording materials, for example, a photosensitive material and an image receiving material is known.

A solvent application portion for forming an image having a tank storing a solvent for forming an image which is used for application to the photosensitive material is disposed within this kind of image forming apparatus, and further a heat developing and transferring portion comprising a heating drum and an endless pressing belt pressed into contact with the outside of the heating drum and rotating with the heating drum is disposed within the image forming apparatus.

A photosensitive material on which the image is exposed while being held and conveyed within the image forming apparatus is soaked in the tank in which water acting as the image forming solvent is stored at the image forming solvent application portion, and is fed to the heat developing and transferring portion after the water is applied thereon. On the other hand, the image receiving material is fed to the heat developing and transferring portion in the same manner as the photosensitive material.

In the heat developing and transferring portion, the photosensitive material after the water is applied thereon is put over the image receiving material and in this state wound around the outer periphery of the heating drum while in close contact thereto. Further, both materials are transferred between the heating drum and the endless pressing belt while being held therebetween, and the image is transferred to the image receiving material at the same time as the photosensitive material is heat developed, so that a predetermined image is formed (stored) on the image receiving material.

However, in the case where the photosensitive material is soaked in the tank in which the water acting as the image forming solvent is stored, once the water cames into contact with the photosensitive material, it becomes constantly stored in the tank. As a result of this, bacteria using traces of organic material released from the photosensitive material as a nutrition source grow in the tank so that the water is made dirty. There is thus a risk that the image forming apparatus itself deteriorates and the image quality drops.

Accordingly, a method in which the water supply side, such as the tank, is not in contact with the photosensitive material, and a nozzle plate having nozzles is vibrated so that small water drops are injected from an injector to the photosensitive material and is applied thereto has been thought of.

However, when only the photosensitive material is transferred by a transfer roller, and water drops are simply injected, it is not possible to maintain an even clearance between the injector and the photosensitive material when injecting water drops. Accordingly, the photosensitive material gets too close or too far from the injector, and portions in which the water is not sufficiently supplied arise on the photosensitive material. It is hard to apply the water to the photosensitive material uniformly.

Further, after the water is applied to the photosensitive material and before it permeates into the photosensitive material, there is a risk that the image quality of the photosensitive material is lost when the transfer roller or the like comes into contact with the application surface of the photosensitive material. Accordingly, there is a necessity for transfer with no contact occurring with the photosensitive material after water application or a necessity to heat the photosensitive material so as to accelerate water permeation.

Further, a transfer roller is generally disposed downstream of the photosensitive material in the transfer direction with respect to the injector and the photosensitive material is further transferred by the transfer roller. However, when the photosensitive material enters into the transfer roller, the photosensitive material is given a shock due to a difference in transfer speed and the like, so that this also makes it hard to uniformly apply the water on the photosensitive material.

On the other hand, when the injector is filled with the water, bubbles tend to adhere to the inner wall of the injector, and bubbles entering from the nozzles along with injected water drops adhere to the inner wall of the injector and remain there. Accordingly, there is a risk of pressure loss through bubbles and deterioration of atomization is generated during the atomizing operation of the injector, causing blocking of the nozzles.

Because of this, as mentioned above, portions free of water appear on the photosensitive material, so that uniform coating of the photosensitive material is difficult.

Further, in the case where the structure that the nozzle plate having the nozzle hole is disposed between a pair of lever mechanisms in such a manner as to stride thereover and a water drop is injected by displacing the nozzle plate by means of an actuator, a space for freely swinging the lever mechanism is required in the injector. As a result of this, bumps and pits exist on the inner wall surface of the injector and the bubbles adhere well to the inner wall surface, so that the deterioration in atomization is more easily generated during the atomizing operation of the injector.

SUMMARY OF THE INVENTION

Taking the above described facts into consideration, the first object of the present invention is to obtain an image forming apparatus for uniformly applying an image forming solvent to an image recording material and improving image quality of an image on the image recording material. Further, a second object of the present invention is to obtain a fluid injecting apparatus for uniformly applying an image forming solvent to an image recording material.

In accordance with the first aspect of the present invention, there is provided an image forming apparatus comprising an injector disposed in opposition to the transfer path of an image recording material and injecting an image forming solvent onto the image recording material, and a guide member having a suction hole for suction, disposed in opposition to the injector with respect to the transfer path for the image recording material and guiding the image recording material by sucking through sucking holes.

In accordance with the above image forming apparatus, the following function can be achieved.

The injector disposed in opposition to the transfer path of the image recording material injects the image forming solvent toward the image recording material. Further, the image recording material is sucked by the suction holes of the guide member which is disposed in the side opposite to the injector with respect to the transfer path of the image recording material, and the image recording material is transferred while being guided by the guide member.

Accordingly, since the guide member guides the image recording material by sucking through the suction holes, the clearance between the injector and the image recording material is kept constant when the image forming solvent is injected. In the case where a predetermined clearance can not be maintained due to the curl of the image recording material or the like, there is a risk that the image forming solvent does not adhere uniformly because the image recording material gets too close or too far from the injector.

However, in the present invention, since the clearance is kept constant, portions where the image forming solvent does not adhere are not generated on the image recording material. The image forming solvent can be applied to the image recording material uniformly.

Further, the guide member for guiding the image recording material while sliding the image recording material by sucking with suction holes, is disposed on the side opposite the injector with respect to the transfer path of the image recording material corresponding to the side opposite the non-application surface on which the image forming solvent is not applied. Because of this, since it is not necessary to make the transfer roller or the like touch the application surface after the image forming solvent is applied to the image recording material and before the image forming solvent is permeated into the image recording material, the image quality of the image on the image recording material does not deteriorate.

In accordance with a second aspect of the present invention, there is provided an image forming apparatus comprising an injector disposed in opposition to the transfer path of image recording material and injecting an image forming solvent onto the image recording material, and a heating member having suction holes for suction, disposed in opposition to the injector with respect to the transfer path for the image recording material and heating the image recording material by suction by means of the sucking holes so as to bring the image recording material into close contact with the heating member.

In accordance with the above image forming apparatus, the following function can be achieved.

The injector disposed opposite the transfer path of the image recording material injects the image forming solvent toward the image recording material. Further, the image recording material is sucked by the suction holes of the heating member which is disposed in the side opposite the injector with respect to the transfer path of the image recording material, and the image recording material is heated on the transfer path by the heating member.

Accordingly, since the heating member sucks the image recording material through the suction holes and the image recording material is brought into close contact with the heating member, a clearance between the injector and the image recording material is kept constant when the image forming solvent is injected. Accordingly, the image forming solvent can be uniformly applied onto the image recording material in the same manner as that in the first aspect.

Further, the heating member for heating the image recording material is disposed in the side opposite the injector with respect to the transfer path of the image recording material corresponding to the side opposite the non-application surface on which the image forming solvent is not applied. Accordingly, since it is not necessary to make the transfer roller or the like touch the application surface after the image forming solvent is applied to the image recording material and before the image forming solvent is permeated into the image recording material, and the image recording material is heated by the heating member so as to permeate the image forming solvent into the image recording material in a short time, the quality of the image on the image recording material deteriorates even less.

In accordance with a third aspect of the present invention, there is provided an image forming apparatus comprising an injector disposed opposite the transfer path of an image recording material and injecting an image forming solvent onto the image recording material, a transfer roller disposed downstream of the image recording material in the transfer direction with respect to the injector and transferring the image recording material to which the image forming solvent is injected, a guide member having suction holes for suction, disposed opposite the injector with respect to the transfer path for the image recording material and between the injector and the transfer roller and guiding the image recording material together with suction by means of the sucking holes.

In accordance with the above image forming apparatus, the following function can be achieved.

The injector disposed in opposition to the transfer path of the image recording material injects the image forming solvent toward the image recording material. The image recording material to which the image forming solvent is injected is transferred by the transfer roller disposed in the downstream side of the image recording material in the transfer direction with respect to the injector.

Further, the guide member is disposed in the side opposite the injector with respect to the transfer path of the image recording material and between the injector and the transfer roller, and the image recording material is sucked by the suction holes of the guide member, so that the image recording material is transferred while being guided by the guide member.

Accordingly, the image forming solvent can be uniformly applied to the image recording material in the manner of the first aspect and the image quality of the image on the image recording material is not reduced.

Further, the guide member for guiding the image recording material by sucking the image recording material by means of the suction holes is disposed between the injector and the transfer roller. Accordingly, since the image recording material is sucked by the suction holes, even when any shock is added to the image recording material at a time when the image recording material enters into the transfer roller, the shock is not transmitted to the portion of the image recording material positioned in opposition to the injector. As a result of this, it is possible to apply the image forming solvent to the image recording material more uniformly.

In accordance with a fourth aspect of the present invention, there is provided a fluid injecting apparatus comprising an injecting tank disposed opposite a transfer path of an image recording material and storing an image forming solvent, a filling material filled within the injecting tank and forming an inner wall surface of the injecting tank with a smoothly curved surface, and a nozzle plate disposed in the injecting tank as a part of the wall surface of the injecting tank opposing the transfer path of the image recording material, having a plurality of nozzle holes for injecting an image forming solvent and oscillating to inject the image forming solvent from the plurality of nozzle holes.

In accordance with the above image forming apparatus, the following function can be achieved.

The image forming solvent is stored within the injecting tank having the inner wall surface formed by the smoothly curved surface of the filling material, and the injecting tank is disposed opposite the transfer path of the image recording material. The nozzle plate having the plurality of nozzle holes for injecting the image forming solvent is disposed in the injecting tank as a part of the wall surface of the injecting tank which opposes the transfer path of the image recording material, and the nozzle plate oscillates so that the image forming solvent is injected from the plurality of nozzle holes.

On the other hand, when the injecting tank is filled with the image forming solvent, the bubbles are attached to the wall surface of the injecting tank, the nozzle holes are provided in a part of the wall surface of the injecting tank, so that the bubbles presumably enter the injecting tank from the nozzle holes when the image forming solvent is injected. However, since the inner wall surface of the injecting tank is formed of a smoothly curved surface of the filling material, the bubbles rise within the injecting tank and leave the injecting tank without adhering to and accumulating on the inner wall surface of the injecting tank.

Accordingly, since the pressure loss together with compression of the bubbles during the atomizing operation does not occur, the deterioration in atomization due to image forming solvent not leaving the nozzle holes does not occur. This means that the portion where the image forming solvent does not adhere to the image recording material does not appear.

As a result of this, the image forming solvent can be applied to the image recording material uniformly.

In accordance with a fifth aspect of the present invention, there is provided a fluid injecting apparatus comprising an injecting tank disposed opposite a transfer path of an image recording material and storing an image forming solvent, a filling material filled within the injecting tank and forming an inner wall surface of the injecting tank with a smoothly curved surface, a nozzle plate disposed in the injecting tank as a part of the wall surface of the injecting tank opposing the transfer path of the image recording material and having a plurality of nozzle holes for injecting an image forming solvent, and an actuator for oscillating the nozzle plate along a direction toward the image recording material on the transfer path.

In accordance with the above image forming apparatus, the following function can be achieved.

The present aspect achieves the same function as that of the fourth aspect. However, in this aspect, since the actuator oscillates the nozzle plate along the direction toward the image recording material on the transfer path, the image forming solvent filled in the injecting tank is injected from the plurality of nozzle holes in correspondence to the motion of the actuator.

Accordingly, it is considered that the bubbles enter the injecting tank from the nozzle holes. However, in the manner of the fourth aspect, the bubbles rise within the injecting tank and leave the injecting tank without adhering to and accumulating on the inner wall surface of the injecting tank. As a result of this, in the same manner as that of the fourth embodiment, the image forming solvent can be applied to the image recording material uniformly.

In accordance with a sixth aspect of the present invention, there is provided a fluid injecting apparatus comprising an injecting tank disposed opposite a transfer path of an image recording material and storing an image forming solvent, a nozzle plate disposed in the injecting tank as a part of the wall surface of the injecting tank opposing the transfer path of the image recording material and having a plurality of nozzle holes for injecting an image forming solvent, a displacement transmitting member connected to an end portion of the nozzle plate, a supporting portion disposed between the wall surface of the injecting tank and the displacement transmitting member and supporting the displacement transmitting member in such a manner as to swing freely, an actuator disposed at a position of the displacement transmitting member in correspondence to the plurality of nozzle holes with respect to the supporting portion in a contact manner and swinging the displacement transmitting member around the supporting portion so as to press the image forming solvent within the injecting tank by means of the nozzle plate connected to the displacement transmitting member, and an elastic member filled in a portion between the wall surface of the injecting tank and the displacement transmitting member, elastically deformed so as to swing the displacement transmitting member around the supporting portion and filling a space between the wall surface of the injecting tank and the displacement transmitting member so as to make the inner wall surface of the injecting tank a smoothly curved wall surface.

In accordance with the above image forming apparatus, the following function can be achieved.

The injecting tank storing the image forming solvent is disposed opposite the transfer path of the image recording material. The nozzle plate having the plurality of nozzle holes for injecting the image forming solvent is disposed in the injecting tank as a part of the wall surface of the injecting tank opposing the transfer path of the image recording material.

Further, the displacement transmitting member connected to the end portion of the nozzle plate is supported by the supporting portion in such a manner as to swing freely and the actuator swings the displacement transmitting member around the supporting portion, so that the nozzle plate connected to the displacement transmitting member presses the image forming solvent within the injecting tank.

The elastic material filled in the portion between the wall surface of the injecting tank and the displacement transmitting member elastically deforms at a time of oscillation of the displacement transmitting member around the supporting portion so as not to prevent the swing. Then, the elastic member fills the space between the wall surface of the injecting tank and the displacement transmitting member so as to make the inner wall surface of the injecting tank the smoothly curved wall surface.

Accordingly, since the displacement transmitting member is swung around the supporting portion together with the operation of the actuator, the portion on the nozzle plate in correspondence to the plurality of nozzle holes is displaced so that the image forming solvent filled in the injecting tank is injected from the plurality of nozzle holes.

Together with this, it is considered that the bubbles enter the injecting tank from the nozzle holes. However, since the inner wall surface of the injecting tank is made of the smoothly curved wall surface by the elastic member, the bubbles rise within the injecting tank and leave the injecting tank without adhering to and accumulating on the inner wall surface of the injecting tank.

Accordingly, since pressure loss along with compression of the bubbles during the atomizing operation does not occur, the deterioration in the atomization due to image forming solvent not leaving the nozzle holes does not occur. This means that the portion where the image forming solvent does not adhere to the image recording material does not appear.

As a result of this, it is possible to apply the image forming solvent to the image recording material uniformly.

In accordance with the seventh aspect of the present invention, there is provided an image forming apparatus comprising an injector which is disposed so as to oppose the conveying path of an image recording material and injects an image forming solvent onto the image recording material; and a guide member applied an adhesive material thereto, disposed on the opposite side of the conveying path with respect to the injector, and guiding the image recording material.

In accordance with the eighth aspect of the present invention, there is provided an image forming apparatus comprising an injector which is disposed so as to oppose the conveying path of an image recording material and injects an image forming solvent onto the image recording material; and a guide member, disposed on the opposite side of the conveying path with respect to the injector, and guiding the image recording material, wherein the guide member is a plurality of suction members for suction the image recording material.

In accordance with the ninth aspect of the present invention, there is provided an image forming apparatus comprising an injector which is disposed so as to oppose the conveying path of an image recording material and injects an image forming solvent onto the image recording material; and a guide member, disposed on the opposite side of the conveying path with respect to the injector, and guiding the image recording material.

BRIEF DESCRIPTION OF THE DRAWINGS

FIGS. 16A, 16B and 16C are schematic views which explain an assembly of the injecting tank in accordance with the second embodiment of the present invention, in which FIG. 16A is a schematic view which shows a state before a pair of frames are combined therewith, FIG. 16B is a schematic view which shows a filling of an elastic material, and FIG. 16C is a schematic view which shows a mounting of a nozzle plate.

DETAILED DESCRIPTION OF THE PREFERRED EMBODIMENTS

Figure 1:
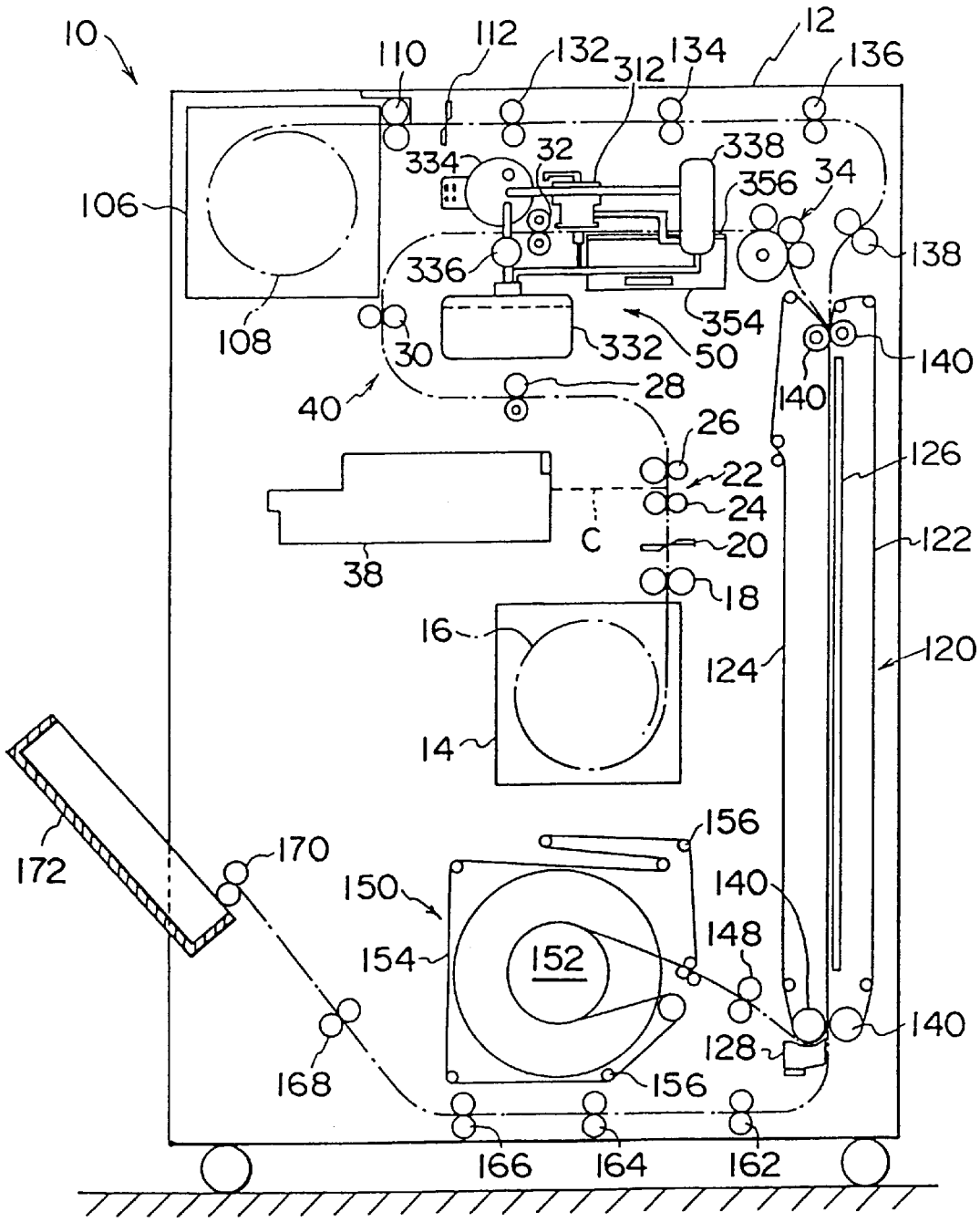
FIG. 1 is a schematic view of a total structure of an image recording apparatus in accordance with a first embodiment of the present invention.

FIG. 1 is a schematic view of the total structure of an image recording apparatus 10 which corresponds to an image forming apparatus in accordance with a first embodiment of the present invention.

A sensitive magazine 14 for receiving a photosensitive material 16 is disposed within a machine casing 12 of the image recording apparatus 10 shown in the drawing, and the photosensitive material 16 is taken up to the sensitive magazine 14 in a roll manner so that a photosensitive (an exposure) surface of the photosensitive material 16 taking out from the sensitive magazine 14 is directed leftward.

A nip roller 18 and a cutter 20 are disposed near a take-out port of the sensitive magazine 14, thereby cutting the photosensitive material 16 after a predetermined length of photosensitive material 16 is taken out from the sensitive magazine 14. The cutter 20 is, for example, a circular type cutter comprising a fixed blade and a moving blade, in which the photosensitive material 16 can be cut by vertically moving the moving blade by means of a rotary cam and the like and engaging with the fixed blade.

A plurality of transfer rollers 24, 26, 28, 30, 32 and 34 are successively disposed downstream of the photosensitive material 16 in a transfer direction with respect to the cutter 20, and a guide plate (not shown in FIG. 1) is disposed between the respective transfer rollers. The photosensitive material 16 cut at a predetermined length is transferred to an exposing portion 22 provided between the transfer rollers 24 and 26.

An exposing apparatus 38 is provided in the left hand side of the exposing portion 22. Three kinds of LD, lens unit, polygon mirror and mirror unit (these are omitted from the drawing) are disposed in the exposing apparatus 38, and a ray C is fed to the exposing portion 22 from the exposing apparatus 38, and so that the photosensitive material 16 is exposed.

Further, a U-turn portion 40 for curving the photosensitive material 16 in a U-shaped manner and for transferring it, and a water application portion 50 for applying an image forming solvent are provided above the exposing portion 22. In this case, water is used for the image forming solvent in the present embodiment.

Each of the photosensitive materials 16 ascending from the sensitive magazine 14 and exposed in the exposing portion 22 is held between the transfer rollers 28 and 30 and transferred thereby so as to pass through the transfer path near the above portion of the U-turn portion 40 and so as to be sent to the water application portion 50.

Figure 2:
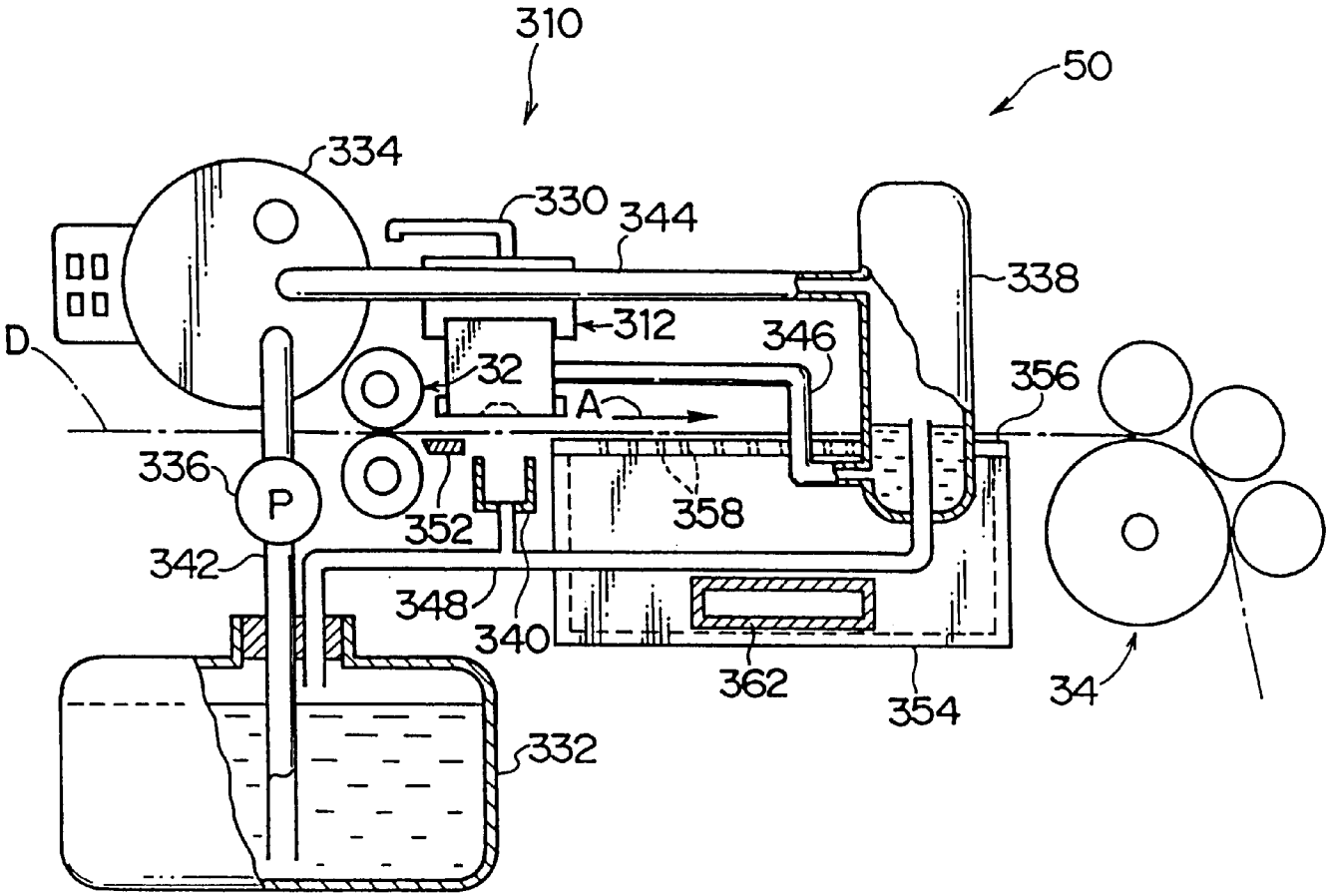
FIG. 2 is a schematic view of a total structure of an application apparatus in accordance with the first embodiment of the present invention.

On the other hand, as shown in FIG. 2, an injecting tank 312 corresponding to an injector constituting a part of an application apparatus 310 corresponding to a fluid injecting apparatus is disposed at a position opposing a transfer path D of the photosensitive material 16 in the water application portion 50.

Further, as shown in FIG. 2, a water bottle 332 storing water for supplying the injecting tank 312 is disposed in the left lower portion of the injecting tank 312, and a filter 334 for filtering the water is disposed in the upper portion of the water bottle 332. Further, a water feeding pipe 342 having a pump 336 disposed in the middle connects the water bottle 332 with the filter 334.

Further, a sub tank 338 storing the water fed from the water bottle 332 is disposed in the right portion of the injecting tank 312 and a water feeding pipe 344 is extended from the filter 334 to the sub tank 338.

Accordingly, when the pump 336 is operated, the water is fed from the water bottle 332 to the filter 334 and the filtered water passing through the filter 334 is fed to the sub tank 338 so that the water is temporarily stored in the sub tank 338.

Still further, a water feeding pipe 346 connecting between the sub tank 338 and the side portion of one end of the injecting tank 312 is disposed therebetween, so that the water fed through the filter 334, the sub tank 338, the water feeding pipe 346 and the like from the water bottle 332 by the pump 336 is filled within the injecting tank 312.

A tray 340 formed like a groove and connected to the water bottle 332 by a circulating pipe 348 is disposed in the lower portion of the injecting tank 312 in FIG. 2. That is, in the side opposing the injecting tank 312 with respect to the transfer path D of the photo sensitive material 16. Accordingly, water spilt from the injecting tank 312 is collected by the tray 340 and is returned to the water bottle 332 through the circulating pipe 348. Further, the circulating pipe 348 is connected to the sub tank 338 in a state of projecting and extending to within the sub tank 338, thereby returning more water than is necessary from where it is stored within the sub tank 338 to the water bottle 332.

Figure 8:
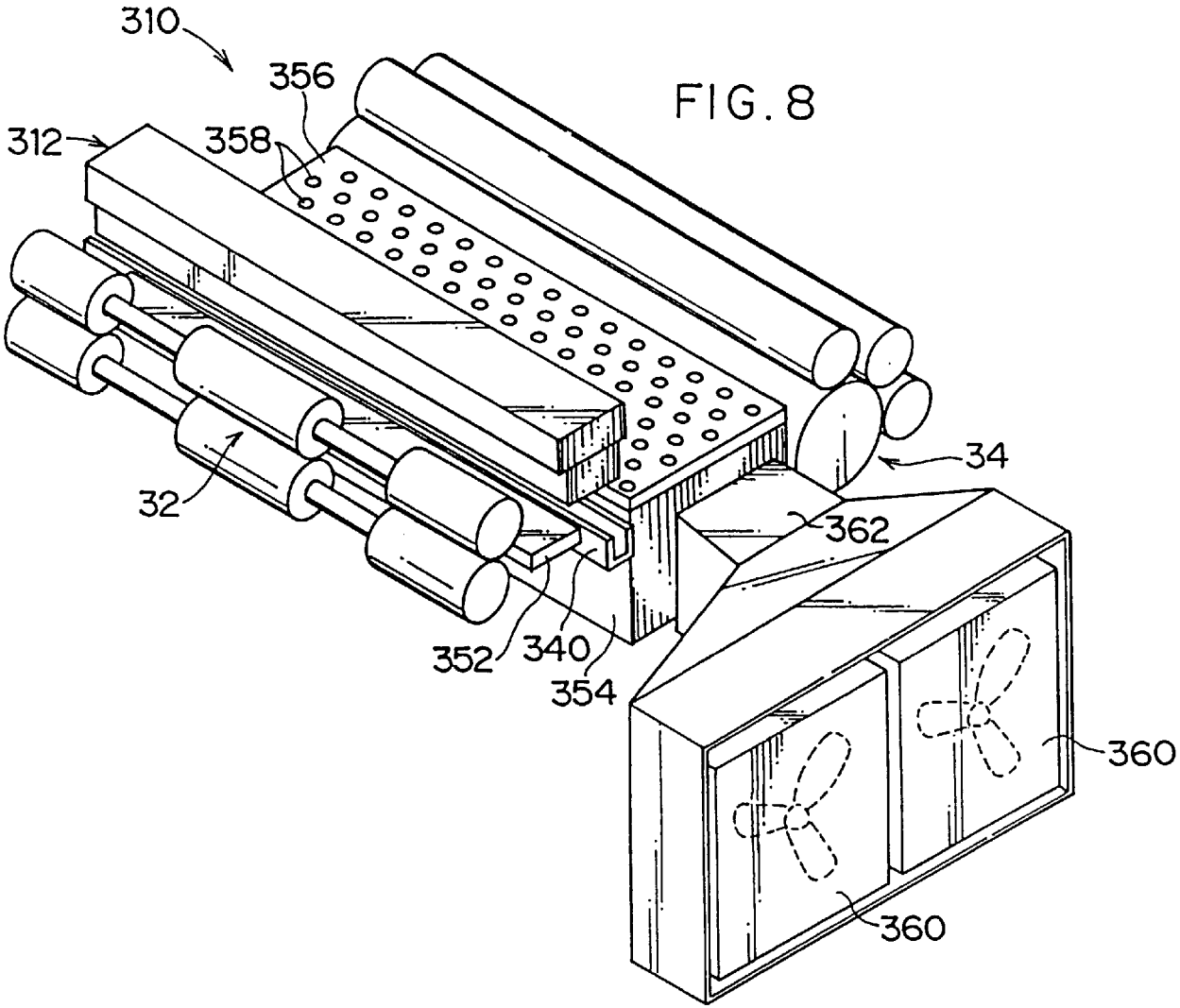
FIG. 8 is a perspective view which shows the application apparatus in accordance with the first embodiment of the present invention.

Further, as shown in FIGS. 2 and 8, a guide plate 352 supporting and guiding the photosensitive material 16 is disposed in the portion between the pair of transfer rollers 32 and the injecting tank 31 and opposite the injecting tank 312 with respect to the transfer path D of the photosensitive material 16.

On the other hand, a box-like chamber 354 having a hollow space therewithin is disposed at a position opposite the injecting tank 312 with respect to the transfer path D of the photosensitive material 16 and downstream of the photosensitive material 16 in the transfer direction with respect to the injecting tank 312. A heating plate 356 having a heater (not shown) and the like built in and having smooth plane plate shape covers over the chamber 354, and a multiplicity of suction holes 358 extending through a portion between the inner portion and the outer portion of the chamber 354 are formed at regular intervals in the heating plate 356. Accordingly, the heating plate 356 constitutes the guide member and the heating member.

Further, as shown in FIG. 8, a pair of fans 360 for sucking air into the chamber 354 are disposed at one end of the chamber 354, and a duct 362 connects the chamber 354 with the fan 360.

Accordingly, by operating the fan 360, the air within the chamber 354 is sucked through the duct 362, and together with this, the suction holes 358 in the heating plate 356 suck the non-application surface (the lower surface in FIG. 2) of the photosensitive material 16, so that the heating plate 356 heats the photosensitive material 16 on the transfer path D and guides the photosensitive material 16.

Further, the transfer roller 34 comprising a plurality of rollers for transferring the photosensitive material 16 after the water is injected is disposed downstream of the transfer path D for the photosensitive material 16 with respect to the injecting tank 312 and the heating plate 356.

Figure 4:
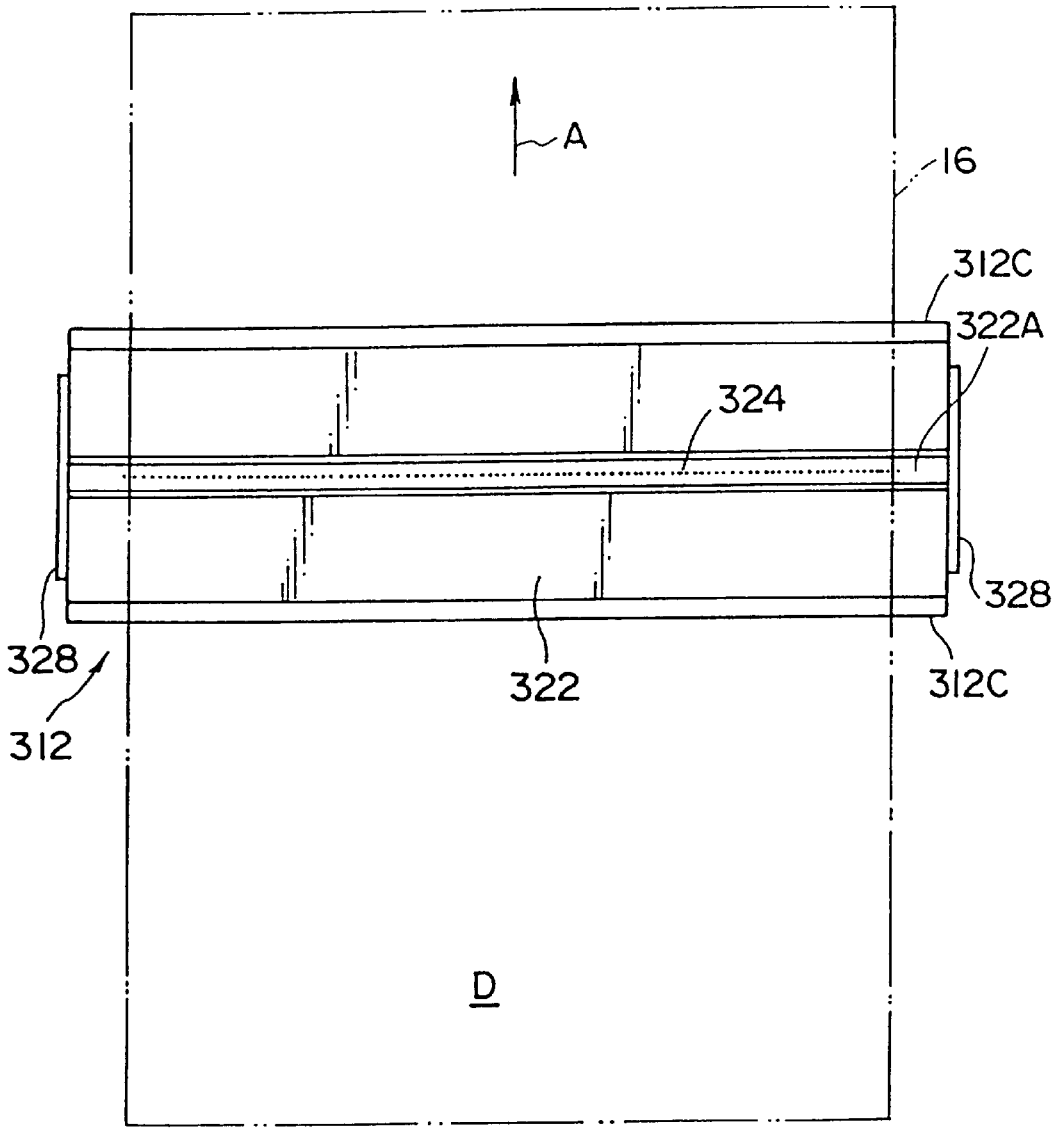
FIG. 4 is a bottom elevational view showing a state in which a photosensitive material is transferred under the injecting tank in accordance with the first embodiment of the present invention.
Figure 6:
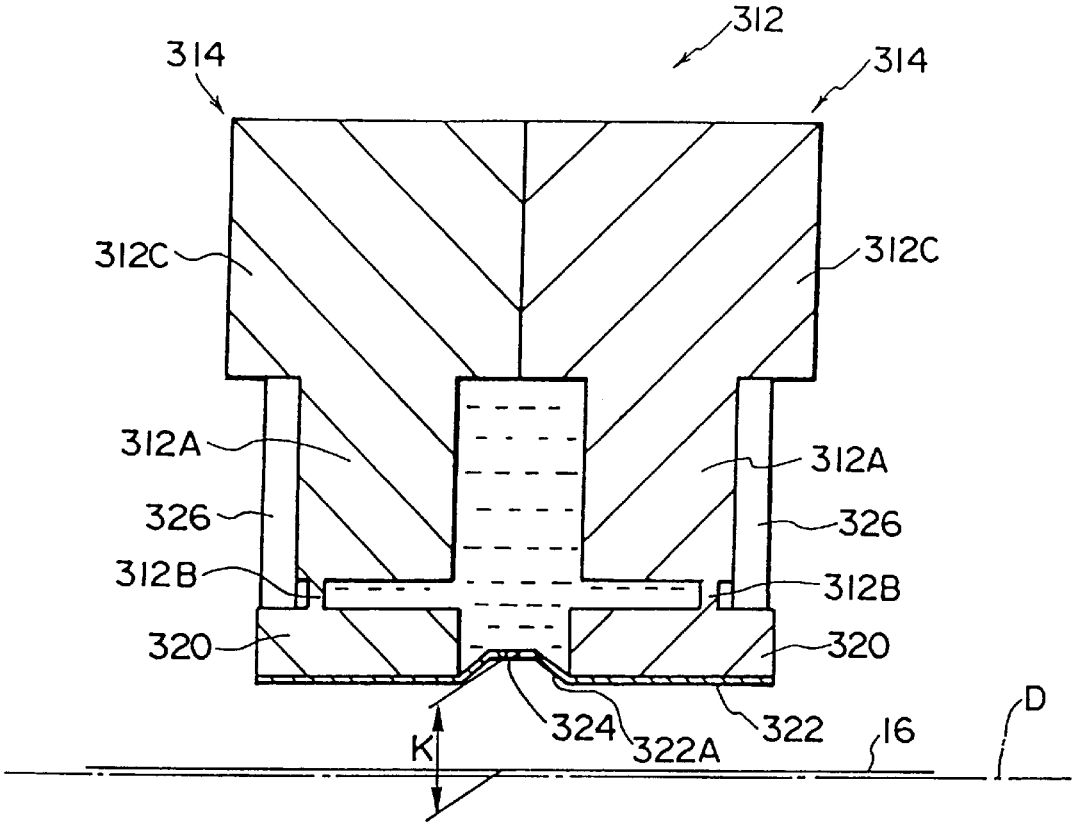
FIG. 6 is a cross sectional view which shows the injecting tank in accordance with the first embodiment of the present invention.

On the other hand, as shown in FIGS. 4 and 6, a bottom wall surface corresponding to a part of the wall surface of the injecting tank 312 becomes a portion opposing the transfer path D for the photosensitive material 16, and a nozzle plate 322 formed by a plate member (for example, a thickness thereof is equal to or less than 60 $\mu$m) having a thin plate shape which has a rectangular shape and is capable of being elastically deformed is provided in the bottom wall surface of the injecting tank 312.

Figure 3:
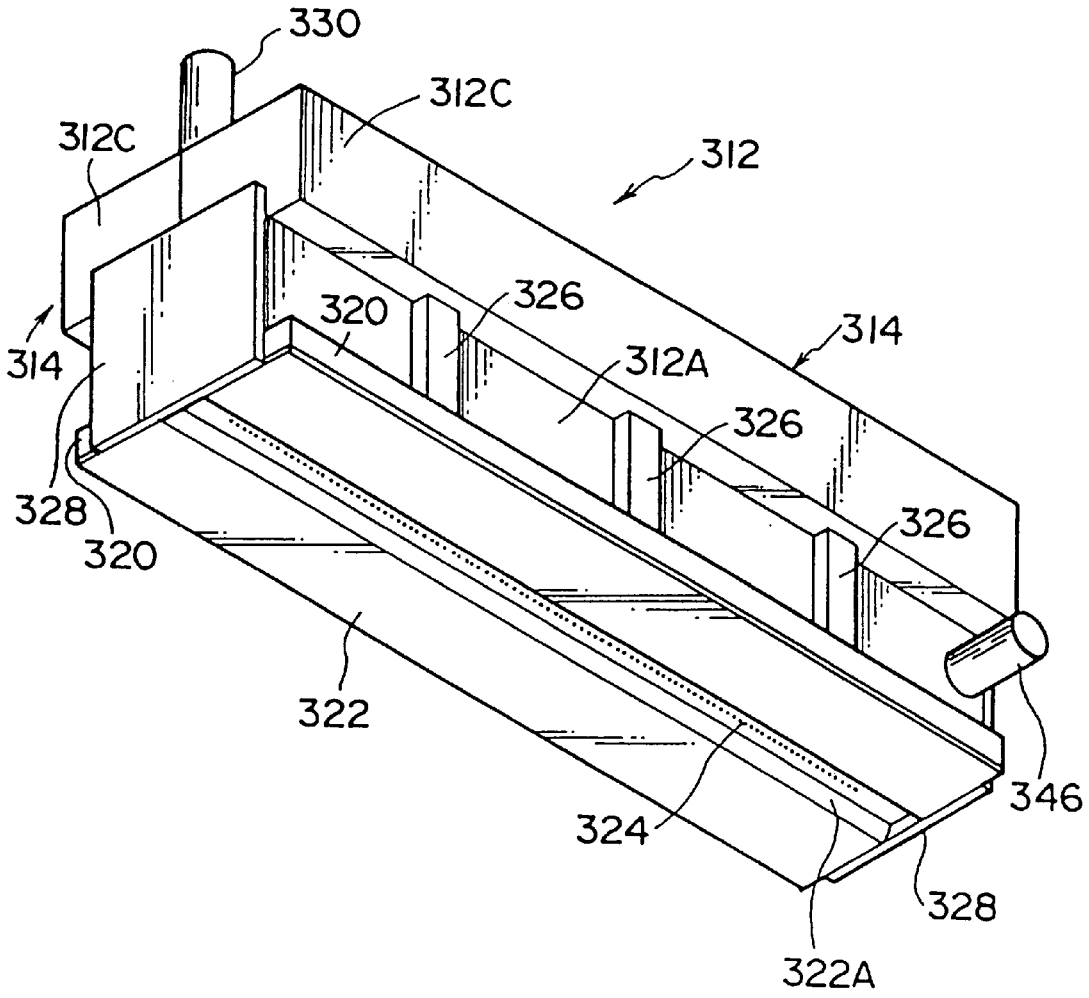
FIG. 3 is an enlarged perspective view of an injecting tank in accordance with the first embodiment of the present invention.
Figure 5:
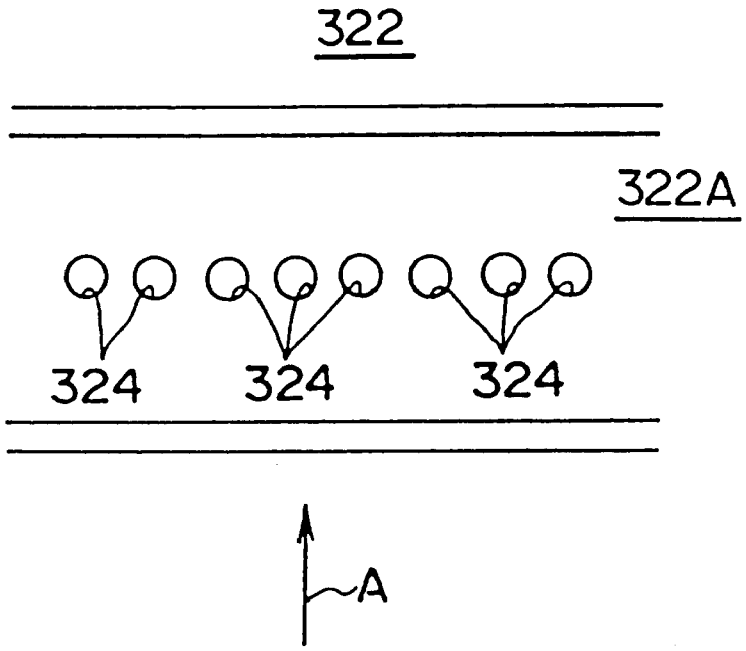
FIG. 5 is an enlarged schematic view of a main portion in FIG. 4.

Then, as shown in FIGS. 3 to 5, a plurality of nozzle holes 324 (having a diameter, for example of from 10 $\mu$m to 200 $\mu$m) linearly disposed along a direction crossing the transfer direction A for the photosensitive material 16 at a constant interval are disposed in the nozzle plate 322 all around the width direction of the photosensitive material 16. Accordingly, the water respectively filled within the injecting tank 312 by the nozzle holes 324 can be injected to the photosensitive material 16.

Still further, a groove portion 322A extending along a direction in which a plurality of nozzle holes 324 are linearly disposed is formed in a curved manner 50 as to increase rigidity of the nozzle plate 322 along the longitudinal direction corresponding to the direction that the plurality of nozzle holes 324 are disposed in the nozzle plate 322.

On the other hand, as shown in FIGS. 2 and 3, an exhaust tube 330 extends from the upper portion of the injecting tank 312 corresponding to the side opposing to the portion to which the water feeding pipe 346 is connected, and the exhaust tube 330 can communicate the inner portion of the injecting tank 312 with the outer portion thereof. Further, a valve (not shown) for opening and closing the exhaust tube 330 is disposed at the middle of the exhaust tube 330, and the portion within the injecting tank 312 can be communicated with the outer air and closed to the outer air by opening and closing the valve.

Both end portions of the nozzle plate 322 corresponding to end portions of the nozzle plate 322 positioned in a direction perpendicular to the longitudinal direction of the nozzle row formed by the linearly disposed plurality of nozzle holes 324 are respectively bonded to a pair of lever plates 320 corresponding to a displacement transfer member by an adhesive or the like, as shown in FIG. 6. Then, the nozzle plate 322 and the pair of lever plates 320 are connected to each other by means of the adhesive. The pair of lever plates 320 are respectively fixed to a pair of side walls 312A through a supporting portion 312B extending along the direction in which the plurality of nozzle holes 324 respectively formed in the lower portion of the pair of side walls 312A of the injecting tank 312 and having narrow width are linearly disposed.

On the other hand, parts of the pair of top walls 312C brought into contact with each other and forming the top surface of the injecting tank 312 project to the outer side of the injecting tank 312 and a plurality of piezoelectric elements 326 (in the present embodiment, three in each side) corresponding to an actuator are bonded and disposed to the lower side of the projecting top wall 312C. The outer end portion of the lever plate 320 corresponding to the portion of the lever plate 320 positioned opposite the plurality of nozzle holes 324 with respect to the supporting portion 312B is bonded to the lower surface of the piezoelectric element 326, so that the piezoelectric element 326 and the lever plate 320 are connected to each other.

Accordingly, the lever mechanism is constituted by the piezoelectric element 326, the lever plate 320 and the supporting portion 312B, and when the outer end portion of the lever plate 320 is moved by the piezoelectric element 326, the lever plate 320 is swung around the supporting portion 312B and the inner end portion of the lever plate 320 is moved to the direction opposite to the motion. In this case, the piezoelectric element 326 is formed by, for example, layered piezoelectric ceramics, so that an axial displacement of the piezoelectric element 326 is enlarged, and the piezoelectric element 326 is connected to a power source (not shown) in which timing of voltage application is controlled by a controller. Further, the valve for opening and closing the exhaust tube 330 mentioned above is also connected to the controller so that the controller controls the opening and closing operation of the valve.

On the other hand, each of the lever plates 320, the side wall 312A, the supporting portion 312B and the top wall 312C forms a part of a frame 314 integrally formed. As shown in FIG. 6, a pair of frames 314 are overlapped and screwed by a bolt (not shown) , so that a pair of lever plates 320, a pair of side walls 312A, a pair of top walls 312C and a pair of supporting portions 312B form an outer frame of the injecting tank 312 in a state that they are respectively disposed in an opposing manner to each other.

In this case, the frame 314 is made of a metal material such as aluminum, brass, magnesium and the like.

As mentioned above, a uniform and large amplitude of the nozzle plate 322 can be obtained along the direction in which a plurality of nozzle holes 324 are linearly disposed by small number of the piezoelectric elements 326. Accordingly, the amplitude can be made such that amplitude distribution along the width direction of the photosensitive material 16 is uniform and the water pressure of the peripheral portion of each of the nozzle holes 324 reach the pressure capable of atomizing. As a result of this, the water can be injected and atomized to all around the width direction of the photosensitive material 16 from the plurality of nozzle holes 324 in a substantially equal manner.

Further, as shown in FIGS. 3 and 4, a thin seal plate 328 is disposed in a portion defined by the right and left ends of the nozzle plate 322 corresponding to the end portion of the nozzle plate 322 positioned in the longitudinal direction of the nozzle row formed by the nozzle holes 324 and the end portions of the pair of frames 314 in a state of being bonded to the pair of frames 314.

Further, the inner portion of the seal plate 328 is filled with an elastic adhesive, for example, comprising a silicon rubber adhesive for the purpose of filling the gap between the right and left ends of the nozzle plate 322 and the end portions of the pair of frame 314, and the seal plate 328 so as to prevent the water from leaking between these elements. Accordingly, the gap of the injecting tank 312 can be sealed by the elastic adhesive without preventing the right and left ends of the nozzle plate 322 from moving. In this case, the right and left ends of the injecting tank 312 may be sealed by only the elastic adhesive without using the thin seal plate 328.

Figure 7:
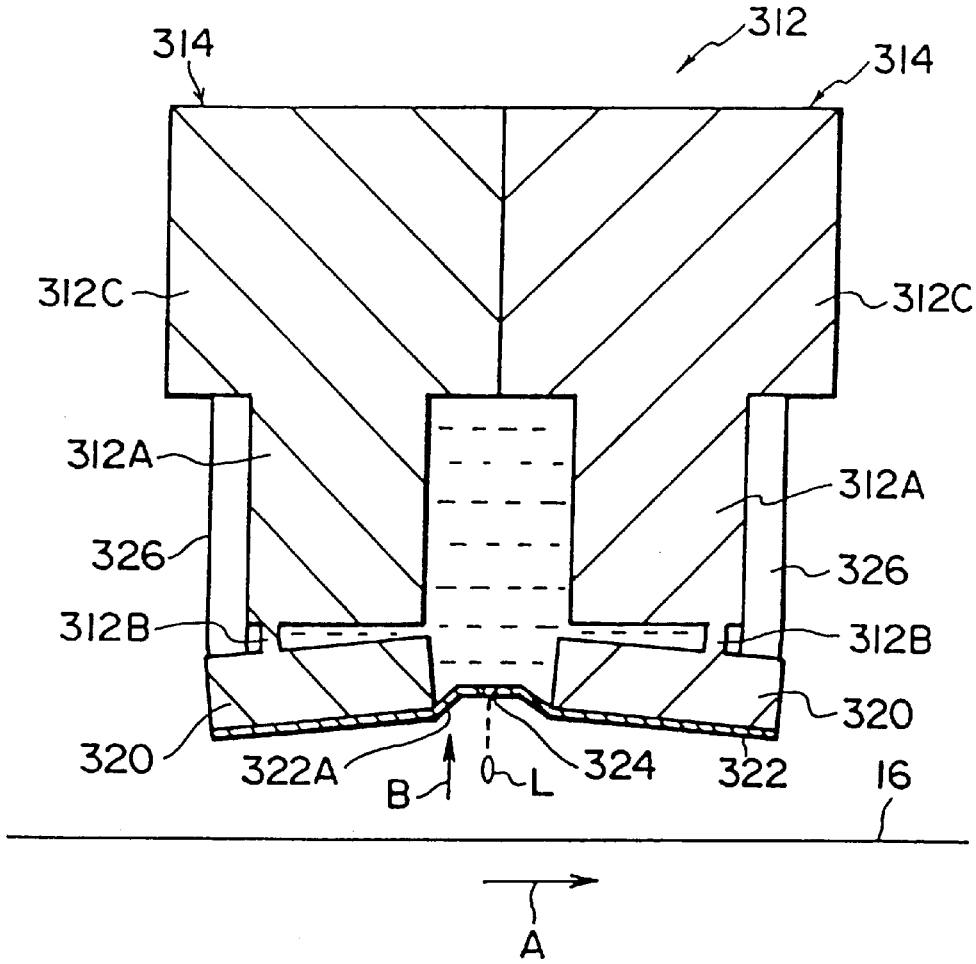
FIG. 7 is a cross sectional view showing a state in which water is injected from the injecting tank in accordance with the first embodiment of the present invention.

As mentioned above, when the piezoelectric element 326 is in contact with the power source, as shown in FIG. 7, the piezoelectric component 326 extends so as to rotate the lever plate 320 around the supporting portion 312B. In accordance with this, the piezoelectric element 326 deforms and displaces the nozzle plate 322 in such a manner as to ascend the center portion of the nozzle plate 322 along an arrow B direction through the lever plate 320. Then, together with this deformation of the nozzle plate 322, the water pressure within the injecting tank 312 is increased so that a water drop L corresponding to a small amount of water is respectively injected from the nozzle holes 324 in a unit in a linear manner.

Further, the piezoelectric element 326 repeatedly makes contact so as to repeatedly extend the piezoelectric element 326, so that the water drop L can be continuously injected from the nozzle holes 324.

On the other hand, as shown in FIG. 1, an image receiving material magazine 106 for receiving an image receiving material 108 is disposed in the left upper end portion within the machine casing 12. A coloring matter fixing material including a mordant is applied to the image forming surface of the image receiving material 108, and the image receiving material 108 is taken up to the image receiving material magazine 106 in a roll manner so that the image forming surface of the image receiving material 108 taken out from the image receiving material magazine 106 is directly lowered.

A nip roller 110 is disposed near an image receiving material taking out port of the image receiving material magazine 106, so that the nip roller 110 nips the image receiving material 108 so as to take out the image receiving material 108 from the image receiving material magazine 106 and to remove the nip operation.

A cutter 112 is disposed in the side of the nip roller 110. The cutter 112 is a rotary type cutter comprising, for example, a fixed blade and a moving blade formed in the same manner as the cutter 20 for the photosensitive material mentioned above. Accordingly, the moving blade of the cutter 20 is vertically moved by means of the rotary cam and the like so as to be meshed with the fixed blade so that the image receiving material 108 taken out from the image receiving material magazine 106 can be cut to a length shorter than the photosensitive material 16.

Transfer rollers 132, 134, 136 and 138 and a guide plate (not shown) are disposed in the side of the cutter 112, so that the image receiving material 108 cut to a predetermined length can be transferred to a heat developing and transferring portion 120.

Figure 10:
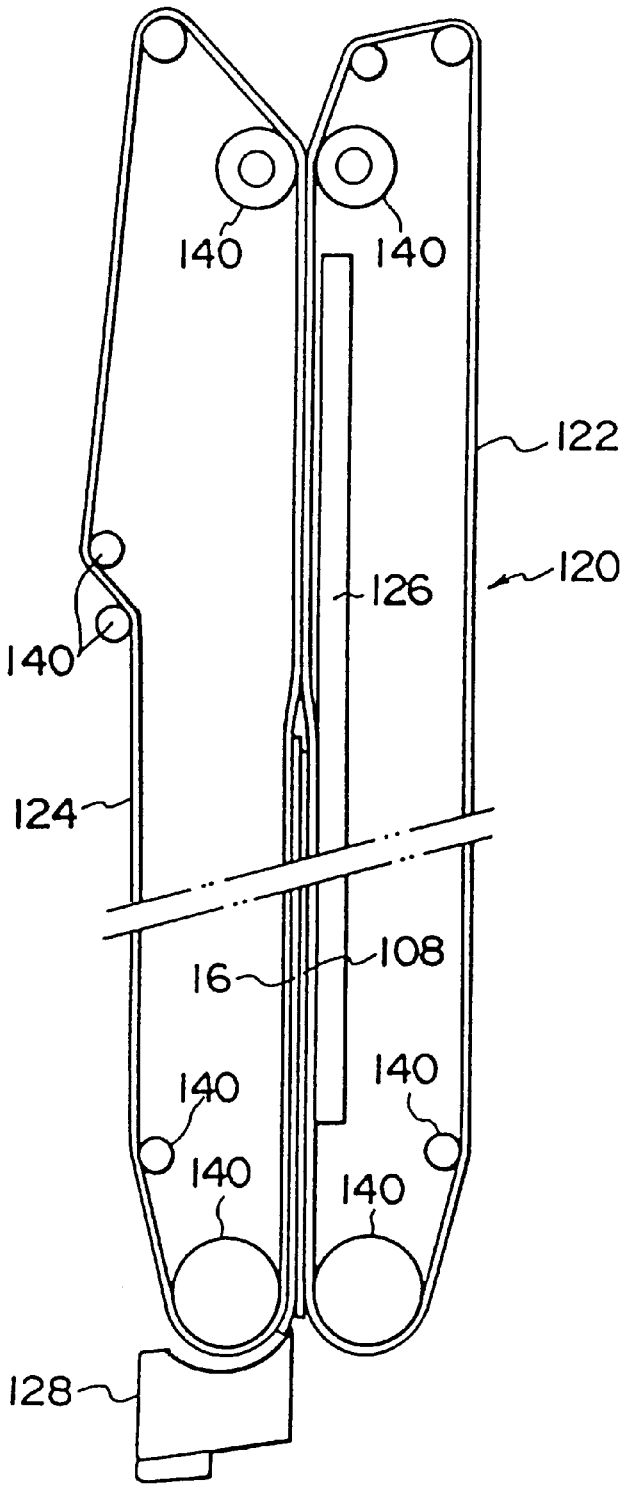
FIG. 10 is an enlarged schematic view which shows a heat developing and transferring portion in accordance with the first embodiment of the present invention.

As shown in FIGS. 1 and 10, the heat developing and transferring portion 120 are respectively wound around a plurality of winding rollers 140, and each of them has a pair of endless belts 122 and 124 having a vertical direction for a longitudinal direction and formed as a loop. Accordingly, when any of the winding rollers 140 is driven and rotated, the pair of endless belts 122 and 124 wound around the winding rollers 140 are respectively rotated.

A heating plate 126 having a vertical direction for a longitudinal direction and formed as a plane plate shape is disposed within the loop of the right endless belt 122 in the drawing among the pair of endless belts 122 and 124 so as to oppose the inner peripheral portion in the left side of the endless belt 122. A linear heater (not shown) is disposed within the heating plate 126, and the temperature on the surface of the heating plate 126 is increased by this heater so as to heat to a predetermined temperature.

Accordingly, the photosensitive material 16 is fed to the portion between the pair of endless belts 122 and 124 of the heat developing and transferring portion 120 by means of the last transfer roller 34 in the transfer path. Further, the image receiving material 108 is transferred in a synchronous manner with the transfer of the photosensitive material 16, and when the photosensitive material 16 goes a predetermined length forward, the photosensitive material 16 is fed to the portion between the pair of endless belts 122 and 124 of the heat developing and transferring portion 120 by means of the last transfer roller 138 in the transfer path, thereby being overlapped on the photosensitive material 16.

In this case, since the image receiving material 108 is smaller in both width direction size and the longitudinal direction size than the photosensitive material 16, they are overlapped in a state that all four lines of the peripheral portion of the photosensitive material 16 project from the peripheral portion of the image receiving material 108.

As mentioned above, the photosensitive material 16 and the image receiving material 108 overlapped by the pair of endless belts 122 and 124 are held between the pair of endless belts 122 and 124 and transferred by the pair of endless belts 122 and 124 in a state of being overlapped. Further, at a time when the overlapped photosensitive material 16 and the image receiving material 108 are completely received in the portion between the pair of endless belts 122 and 124, the pair of endless belts 122 and 124 temporarily stop rotating and the held photosensitive material 16 and the image receiving material 108 are heated by the heating plate 126. The photosensitive material 16 is heated through the endless belt 122 and the heating plate 126 at a time of being held and transferred and of being stopped, and discharges a movable coloring matter together with the heating, and at the same time, the coloring matter is transferred to the coloring matter fixing layer of the image receiving material 108 so that the image can be obtained on the image receiving material 108.

Further, a break away hook 128 is disposed in the downstream side in the material supply direction with respect to the pair of endless belts 122 and 124. Accordingly, the break away hook 128 is engaged with only a front end portion of the photosensitive material 16 among the photosensitive material 16 and the image receiving material 108 held and transferred between the pair of endless belts 122 and 124, thereby breaking the front end portion of the photosensitive material 16 projecting from the portion between the pair of endless belts 122 and 124 away from the image receiving material 108.

A photosensitive material discharging roller 148 is disposed in the left portion of the break away hook 128 and is structured in such a manner as to transfer the photosensitive material 16 moved leftward while being guided by the break away hook 128 further to a waste photosensitive material receiving portion 150 end.

The waste photosensitive material receiving portion 150 has a drum 152 around which the photosensitive material 16 is wound and a belt 154 which is partially wound around the drum 152. The belt 154 is wound around a plurality of rollers 156, and the belt 154 is rotated by the rotation of these rollers 156 so that the drum 152 is accordingly rotated.

Accordingly, in a state that the belt 154 is rotated by the rotation of the rollers 156, when the photosensitive material 16 is fed, it is structured such that the photosensitive material 16 can be collected around the drum 152.

On the other hand, in FIG. 1, image receiving material discharging rollers 162, 164, 166, 168 and 170 are successively disposed in such a manner as to transfer the image receiving material 108 leftward from the lower portion of the pair of endless belts 122 and 124. Accordingly, the image receiving material 108 discharged from the pair of endless belts 122 and 124 is transferred by these image receiving material discharging rollers 162, 164, 166, 168 and 170 so as to be discharged to a tray 172.

Next, an operation of the present embodiment will be described below.

In the image recording apparatus 10 having the above structure, the nip roller 18 is operated after the photosensitive material magazine 14 is set, so that the photosensitive material 16 is taken out by the nip roller 18. When the photosensitive material 16 is taken out at a predetermined length, the cutter 20 is operated, so that the photosensitive material 16 is cut at a predetermined length and is transferred to the developing portion 22 in a state of directing the photosensitive surface (the developing surface) leftward. Then, at the same time when the photosensitive material 16 passes through the developing portion 22, the developing apparatus 38 is operated, so that the image is scanned and developed to the photosensitive material 16 positioned at the developing portion 22.

After completion of the development, the developed photosensitive material 16 is fed to the water application portion 50. In the water application portion 50, the transferred photosensitive material 16 is fed to the injecting tank 312 by the operation of the transfer roller 32, as shown in FIG. 4.

Then, the water is attached to the photosensitive material 16 transferred along the transfer path D by the injection of the injecting tank 312. Motion and operation at this time will be described below.

Then injecting tank 312 disposed opposite the transfer path D of the photosensitive material 16 and storing the water injects the water to the photosensitive material 16. Further, the transfer roller 34 disposed downstream of the transfer path D of the photosensitive material 16 with respect to the injecting tank 312 further transfers the photosensitive material 16 after the water is injected.

Further, the heating plate 356 is disposed in the side opposite the injecting tank 312 with respect to the transfer path D of the photosensitive material 16 and between the injecting tank 312 and the transfer roller 34. The photosensitive material 16 is sucked by the suction holes 358 of the heating plate 356 and heated by the heating plate 356 on the transfer path D, and the photosensitive material 16 is also guided and transferred by the heating plate 356.

Figure 9:
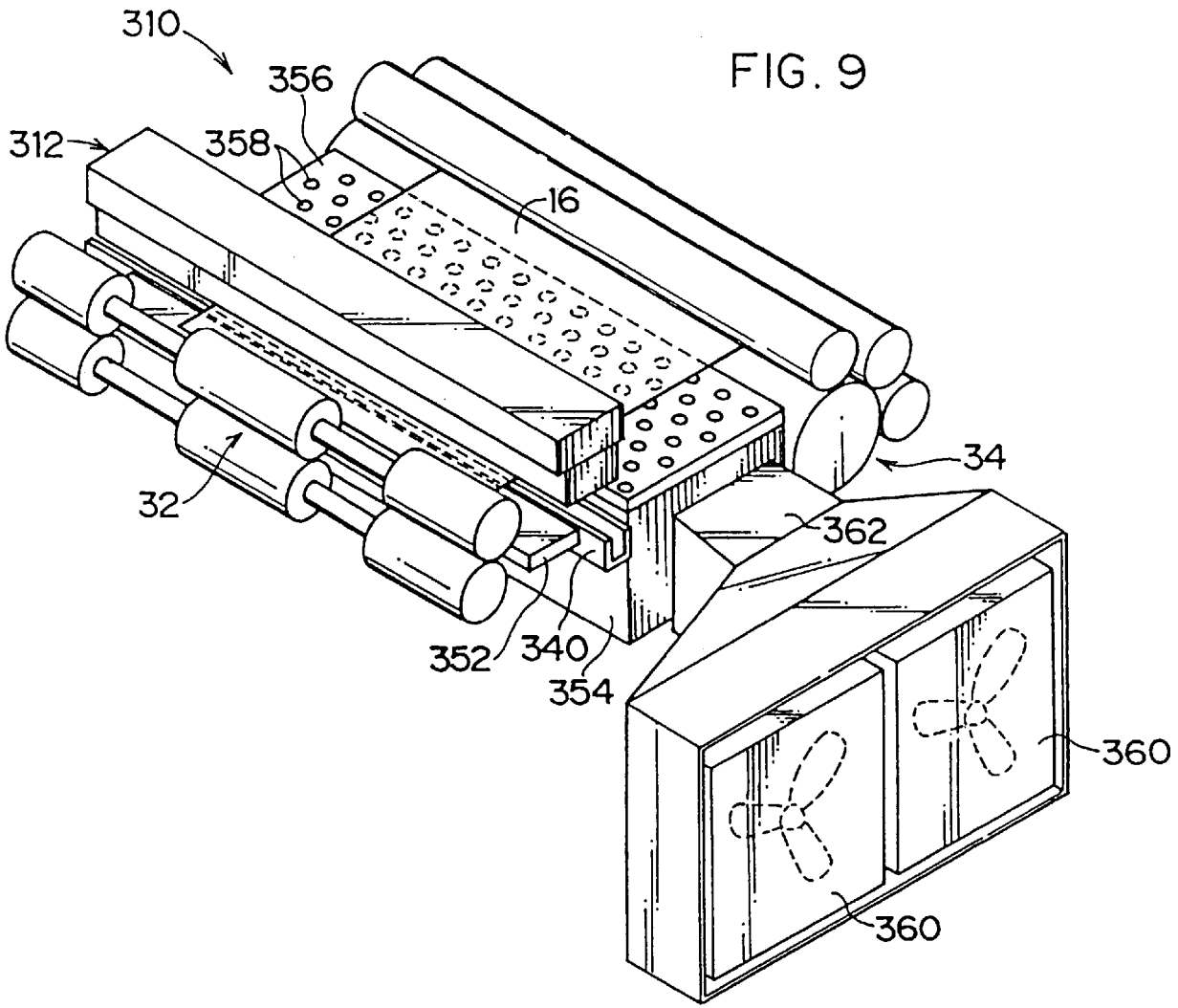
FIG. 9 is a perspective view showing the application apparatus in accordance with the first embodiment of the present invention, in which a state that a photosensitive material is heated is shown.

Concretely speaking, the photosensitive material 16 is fed while being slid on the heating plate 356 after being transferred by the transfer roller 32 shown in FIGS. 2 and 8 on the transfer path D and having water attached to the front end portion of the photosensitive material 16 by injection of the injecting tank 312. As shown in FIG. 9, when the front end portion of the photosensitive material 16 is held between the transfer rollers 34, the transfer of the photosensitive material 16 is stopped, for example, only for some seconds, and the photosensitive material 16 is heated by the heating plate 356.

Thereafter, the transfer is restarted by the transfer roller 34, so that the photosensitive material 16 is fed out from the heating plate 356.

Accordingly, since the heating plate 356 sucks the photosensitive material 16 by the suction holes 358 and the photosensitive material 16 is brought into close contact with the heating plate 356 and the photosensitive material 16 is guided with sliding, a clearance K (shown in FIG. 6) between the injecting tank 312 and the photosensitive material 16 can be kept constant when the injecting tank 312 injects the water. Accordingly, portions where water is not attached are not generated on the photosensitive material 16. The water can be applied to the photosensitive material 16 uniformly.

Accordingly, in the case where a predetermined clearance K can not be maintained due to the curl of the photosensitive material 16 and the like, the photosensitive material 16 goes too close to the injecting tank 312 or goes too far from the injecting tank 312, so that there is a risk of water being applied unevenly. However, in the present embodiment, since the clearance K can be kept constant, the water can be applied to the photosensitive material 16 uniformly.

Further, the heating plate 356 is disposed in the side opposite the injecting tank 312 with respect to the transfer path D of the photosensitive material 16 corresponding to the side opposite the non-application surface to which water is not applied. Accordingly, it is not necessary to transfer the photosensitive material in a state of bringing the transfer roller and the like into contact with the application surface corresponding to the photosensitive surface after the water is applied to the photosensitive material 16 and before the water is permeated into the photosensitive material 16, and the water can be permeated into the photosensitive material 16 for a short time by heating the photosensitive material 16 by means of the heating plate 356, so that the image quality of the image on the photosensitive material 16 is not deteriorated.

Further, the heating plate 356 for sucking and guiding the photosensitive material 16 by the suction holes 358 is disposed between the injecting tank 312 and the transfer roller 34. Accordingly, since the photosensitive material 16 is sucked into the suction holes 358, even when the shock is applied to the photosensitive material 16 at a time when the photosensitive material 16 enters into the transfer roller 34 so as to be held therebetween, the impact is not transmitted to the portion of the photosensitive material 16 positioned opposite the injecting tank 312. As a result of this, the water can be more uniformly applied to the photosensitive material 16.

In this case, before the water is injected by the injecting tank 312, at first, the valve of the exhaust tube 330 is closed by the controller. At the time of atomizing and injecting the water in this state, voltage is applied to the piezoelectric element 326 by making contact by means of the power source controlled by the controller, so that all the piezoelectric elements 326 are distorted so as to stretch at the same time.

Then, the plurality of piezoelectric elements 326 are extended and compressed at the same time, the portion of the nozzle plate 322 disposed in around the nozzle holes 324 positioned in a state of being held between the pair of lever plates 320 is oscillated toward the photosensitive material 16 on the transfer path D (in this case, moving in the direction shown by the arrow B in FIG. 7) together with the respective swing motion of the pair of lever plates 320 around the supporting portion 312B, so that the nozzle plates 322 pressurizes the water within the injecting tank 312.

As mentioned above, in accordance with the motion of the piezoelectric element 326, the water filled in the injecting tank 312 is injected from the plurality of nozzle holes 324. As a result of this, the water filled in the injecting tank 312 is injected and atomized from the nozzle holes 324 as shown in FIG. 7 so as to be attached on the photosensitive material 16 while being transferred.

At this time, in accordance with the operation of the piezoelectric element 326, since the lever plate 320 is swung around the supporting portion 312B extending along the direction to which the plurality of nozzle holes 324 are linearly disposed, all of the portion in which the plurality of nozzle holes 324 of the nozzle plate 322 are provided is uniformly displaced.

Accordingly, the nozzle holes 324 can be stably displaced along the longitudinal direction of the nozzle row formed by the linearly disposed plurality of nozzle holes 324 as a unit at the same displacing amount, so that the water filled in the injecting tank 312 is uniformly injected from the plurality of nozzle holes 324. Accordingly, portions where water is not attached are even less likely to arise on the photosensitive material 16.

On the other hand, since the injecting tank 312 has the nozzle holes 324 and the water is injected from the nozzle holes 324, in comparison with the application apparatus which is structured such as to soak the photosensitive material and the like into the tank storing the water and to apply the water, it is possible to apply the water with a little amount of water and it is also possible to dry the photosensitive material 16 in a short time.

Further, since the injecting tank 312 has the plurality of nozzle holes 324 disposed all around the width direction of the photosensitive material 16 and the water is injected from the nozzle holes 324 at the same time through a single deformation by means of the piezoelectric element 326, the water can be widely applied all around the width direction of the photosensitive material 16 in a single injection. Accordingly, it is not necessary to scan the nozzle plate 322 on the two-dimensional plane, and the large area application can be performed in a short time, so that the application time can be reduced.

Still further, as well as the transfer speed of the photosensitive material 16, the water can be applied to all of the surface of the photosensitive material 16 by injecting the water from the nozzle holes 324 at decided on times a number of times. When the water is injected from the nozzle holes 324 of the nozzle plate 322, the water within the injecting tank 312 is reduced gradually. However, since the sub tank 338 has a function of supplying water and keeping the water level within the injecting tank 312 constant, water is supplied from the sub tank 338 so that the water pressure within the injecting tank 312 during the atomization can be kept constant, thereby securing continuous water injection.

Thereafter, the photosensitive material 16 to which the water is applied in the water application portion 50 for the image forming solvent is fed to the portion between the pair of endless belts 122 and 124 of the heat developing and transferring portion 120 by the transfer roller 34.

On the other hand, scanned and developed when the photosensitive material 16, the image receiving material 108 is also taken out from the image receiving material magazine 106 by the nip roller 110 and transferred. When the image receiving material 108 is taken out at a predetermined length, the cutter 112 is operated so that the image receiving material 108 is cut into a predetermined lengths.

After the cutter 112 is employed, the cut image receiving material 108 is transferred by the transfer rollers 132, 134, 136 and 138 while being guided by the guide plate. Once the front end portion of the image receiving material 108 is held between the transfer rollers 138, the image receiving material 108 is on standby immediately before the heat developing and transferring portion 120.

Then, because the photosensitive material 16 is fed into the portion between the pair of endless belts 122 and 124 by the transfer roller 34 as mentioned above, the transfer of the image receiving material 108 is restarted, so that the image receiving material 108 is fed to the portion between the pair of endless belts 122 and 124 as a unit with the photosensitive material 16.

As a result of this, since the photosensitive material 16 and the image receiving material 108 overlap and the photosensitive material 16 and the image receiving material 108 are held and transferred while being heated by the heating plate 126, the image is thermally developed and transferred so as to be formed on the image receiving material 108.

Further, when these are discharged from the pair of endless belts 122 and 124, the break away hook 128 is engaged with the front end portion of the photosensitive material 16 which is transferred at a predetermined length prior to the image receiving material 108, so as to break away the front end portion of the photosensitive material 16 from the image receiving material 108. The photosensitive material 16 is further transferred by the photosensitive material discharging roller 148 and is collected within the waste photosensitive material receiving portion 150. At this time, since the photosensitive material 16 dries quickly, it is not necessary to further provide a kind of heater for drying the photosensitive material 16.

On the other hand, the image receiving material 108 separated from the photosensitive material 16 is transferred by the image receiving material discharging rollers 162, 164, 166, 168 and 170 so as to be discharged to the tray 172.

Then, in the case that a recording operation of a plurality of images is performed, the above processes are successively and continuously performed.

As mentioned above, the image receiving material 108 held between the pair of endless belts 122 and 124 and thermally developed and transferred so that a predetermined image is formed (recorded) is held between the plurality of image receiving material discharging rollers 162, 164, 166, 168 and 170 and transferred so as to be taken out of the apparatus after being discharged from the pair of endless belts 122 and 124.

Next, an image forming apparatus and a liquid injecting apparatus in accordance with a second embodiment of the present invention will be shown in the drawings and be described below. In this case, the same reference numerals are attached to the same elements described in the first embodiment and the explanation thereof will be omitted.

Figure 11:
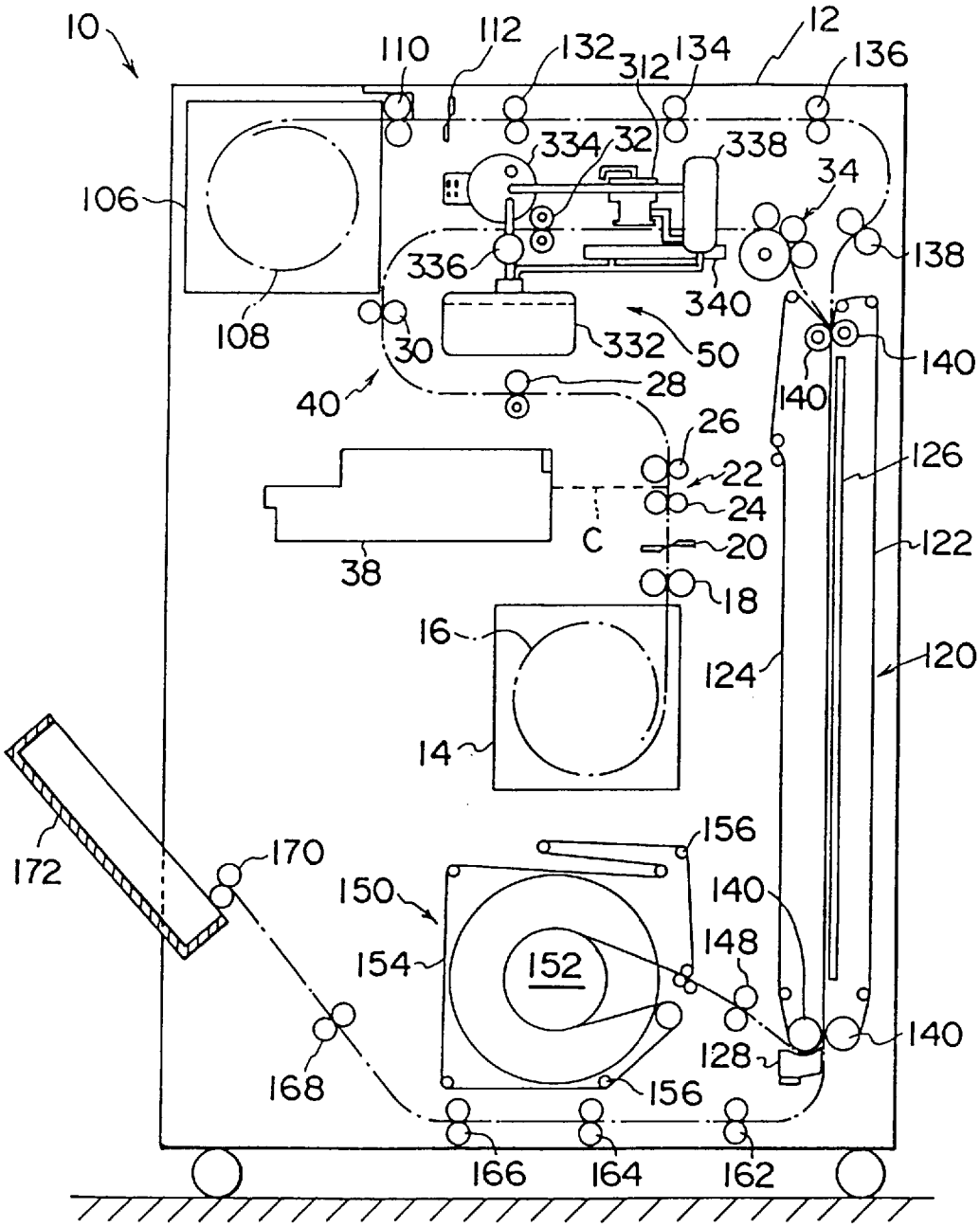
FIG. 11 is a schematic view which schematically shows a total structure of an image recording apparatus in accordance with a second embodiment of the present invention.
Figure 12:
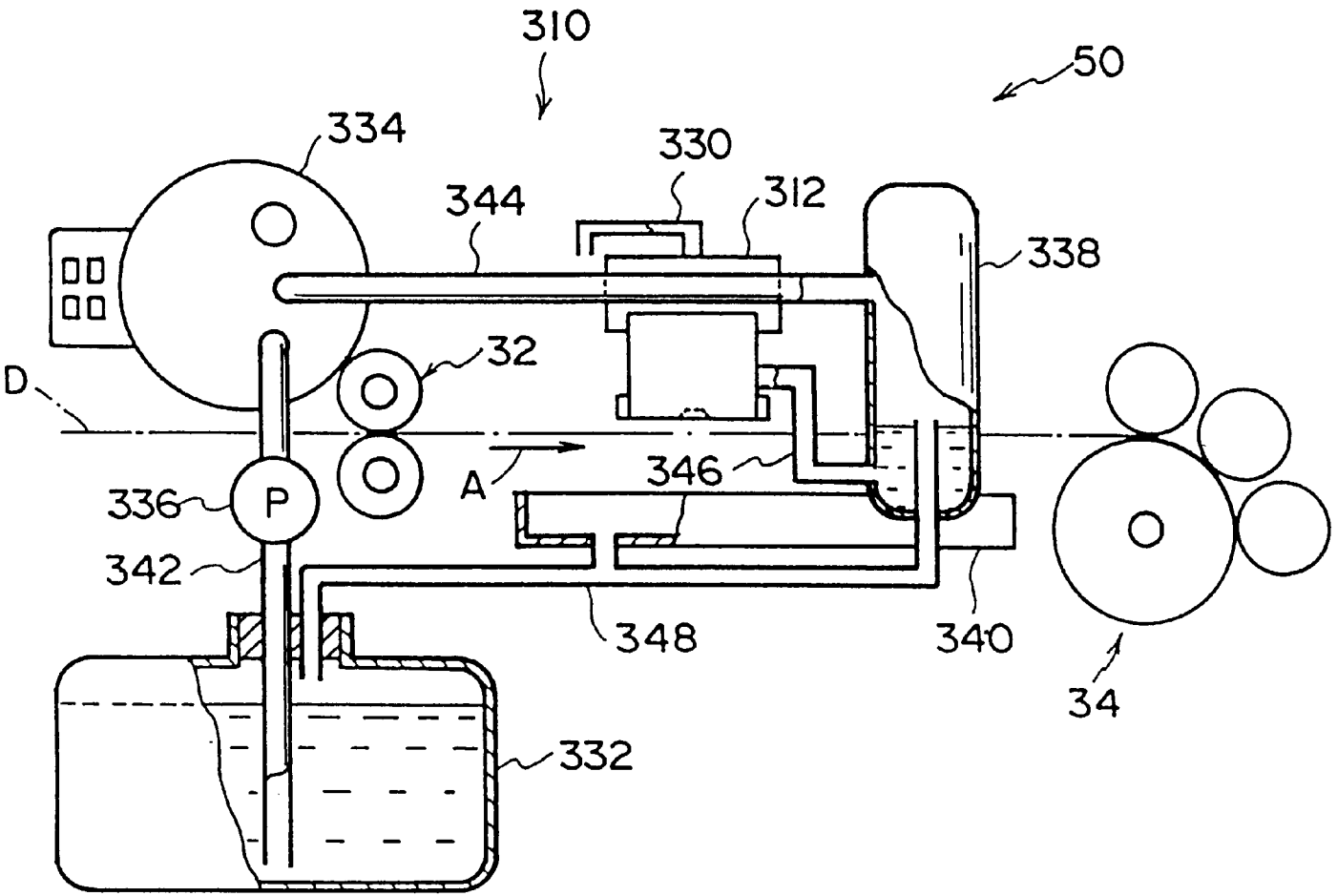
FIG. 12 is a schematic view of a total structure of an application apparatus in accordance with the second embodiment of the present invention.

As shown in FIG. 11 which shows total structure of an image recording apparatus schematically in accordance with the second embodiment and FIG. 12 showing schematically a total structure of an application apparatus in accordance with the second embodiment, the injecting tank 312 is substantially the same in structure as that of the first embodiment and is provided within the image recording apparatus 10.

The tray 340 connected to the water bottle 332 by the circulating pipe 348 is disposed in the lower portion of the injecting tank 312, so that it is structured such that the water overflowing from the injecting tank 312 is collected by the tray 340 and is returned to the water bottle 332 through the circulating pipe 348. Further, the circulating pipe 348 is connected to the sub tank 338 in a state of projecting and extending within the sub tank 338 so as to return the extra water collected within the sub tank 338 to the water bottle 332.

Figure 13:
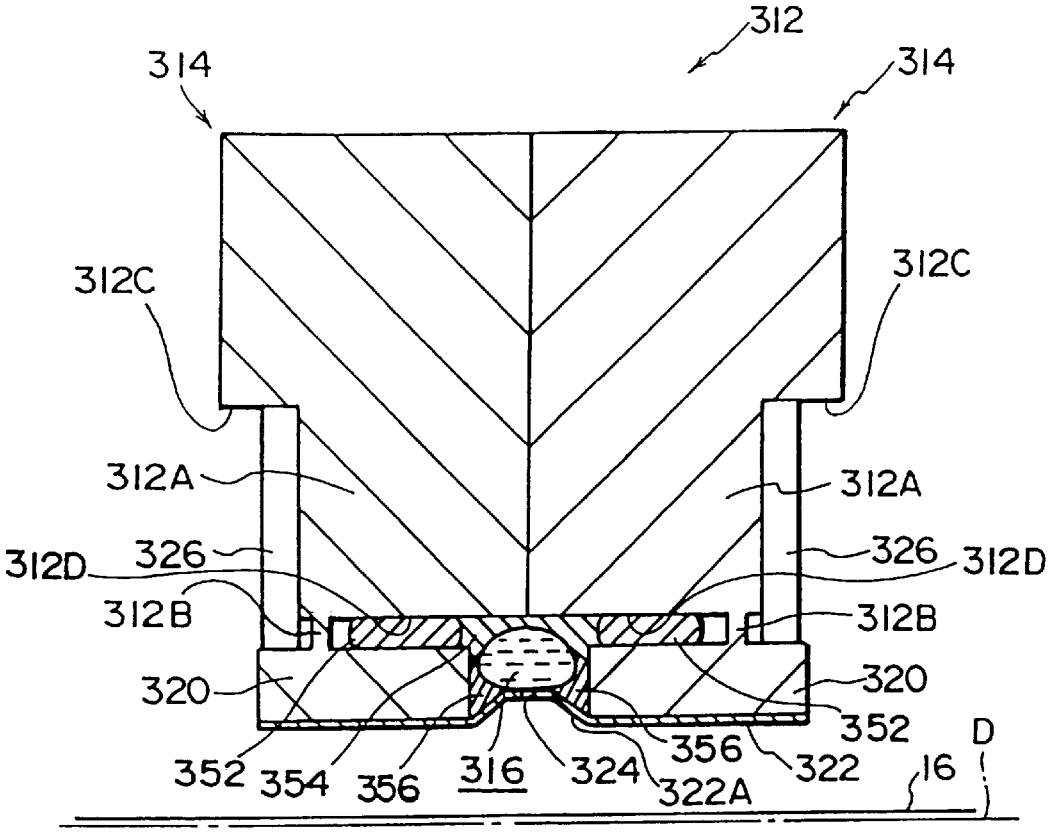
FIG. 13 is a cross sectional view of an injecting tank in accordance with the second embodiment of the present invention.

Further, as shown in FIGS. 4 and 13 explaining the first embodiment, the nozzle plate 322 made of the thin plate material (for example, the thickness thereof is equal to or less than 60 $\mu$m) having a rectangular shape and elastically deforming characteristic is disposed in the portion opposite the transfer path D of the photosensitive material 16 corresponding to the bottom wall surface which is a part of the wall surfaces of the injecting tank 312.

Still further, as in the same manner as shown in FIGS. 3 to 5 corresponding to the first embodiment, the plurality of nozzle holes 324 linearly disposed along the direction crossing the transfer direction A of the photosensitive material 16 at a constant interval are disposed in the nozzle plate 322 all around the width direction of the photosensitive material 16. Further, in the same manner as the first embodiment, the groove portion 322A is formed in the injecting tank 312 and the exhaust tube 330 extends from the upper portion of the injecting tank 312.

Both end portions of the nozzle plate 322 corresponding to the end portion of the nozzle plate 322 positioned in the direction perpendicular to the longitudinal direction of the nozzle row formed by the linearly disposed plurality of nozzle holes 324 are respectively bonded to the pair of lever plates 320 corresponding to the displacement transmitting member by the adhesive and the like as shown in FIG. 13. Then, by bonding and connecting in the above manner, the nozzle plate 322 and the pair of lever plates 320 are connected to each other. The pair of lever plates 320 are respectively fixed to the pair of tank body constituting members 312A through the supporting portions 312B each formed in the wall portion disposed in the lower portion of the pair of tank body constituting members 312A of the injecting tank 312, having a narrow width and extending along the direction in which the plurality of nozzle holes 324 are linearly disposed.

On the other hand, each of the opposing surfaces of the pair of tank body constituting members 312A is formed as a smooth surface without bumps or indentations, and these opposing surfaces are brought into contact with each other with no gap so as to form the upper side portion of the injecting tank 312. Further, the step portion 312C projecting into the outside of the injecting tank 312 at a step is provided in each of the pair of tank body constituting members 312A, so that the injecting tank 312 has a shape in which the upper portion above the middle portion in the vertical direction projects.

The plurality of piezoelectric elements 326 (three in each side in this embodiment) corresponding to the actuator are bonded and disposed in the lower side surface of the step portion 312C. The outer end portion of the lever plate 320 corresponding to the portion of the lever plate 320 positioned while holding the supporting portion 312B with respect to the plurality of nozzle holes 324 is bonded to the lower surface of the piezoelectric element 326, so that the piezoelectric element 326 and the lever plate 320 are connected to each other.

Accordingly, the lever mechanism is constituted by these piezoelectric elements 326, the lever plate 320 and the supporting portion 312B, so that a groove portion 312D for swing motion capable of swinging the lever plate 320 is respectively provided between the pair of lever plates 320 and the pair of tank body constituting members 312A. Then, the elastic member 352 (for example, a silicon adhesive) constituted by the silicon rubber is respectively filled within the swing groove portion 312D.

As mentioned above, when the outer end portion of the lever plate 320 is moved by the piezoelectric element 326, the lever plate 320 is swung around the supporting portion 312B, so that the inner end portion of the lever plate 320 moves in a direction opposing the motion. At this time, the elastic member 352 is sometimes compressed and stretched together with the swing motion of the lever plate 320. It is elastically distorted and does not prevent the swing motion of the lever plate 320.

On the other hand, each of the lever plates 320, the tank body constituting member 312A and the supporting portion 312B forms a part of the integrally formed frame 314. As shown in FIG. 13, the pair of frames 314 are overlapped and screwed by a bolt (not shown), so as to form the outer frame of the injecting tank 312 in a state that the pair of lever plates 320, the pair of tank body constituting members 312A and the pair of supporting portions 312B are respectively disposed in such a manner as to be opposed to each other. In this case, the frame 314 is formed by an extruded material through aluminum extrusion molding.

Figure 15:
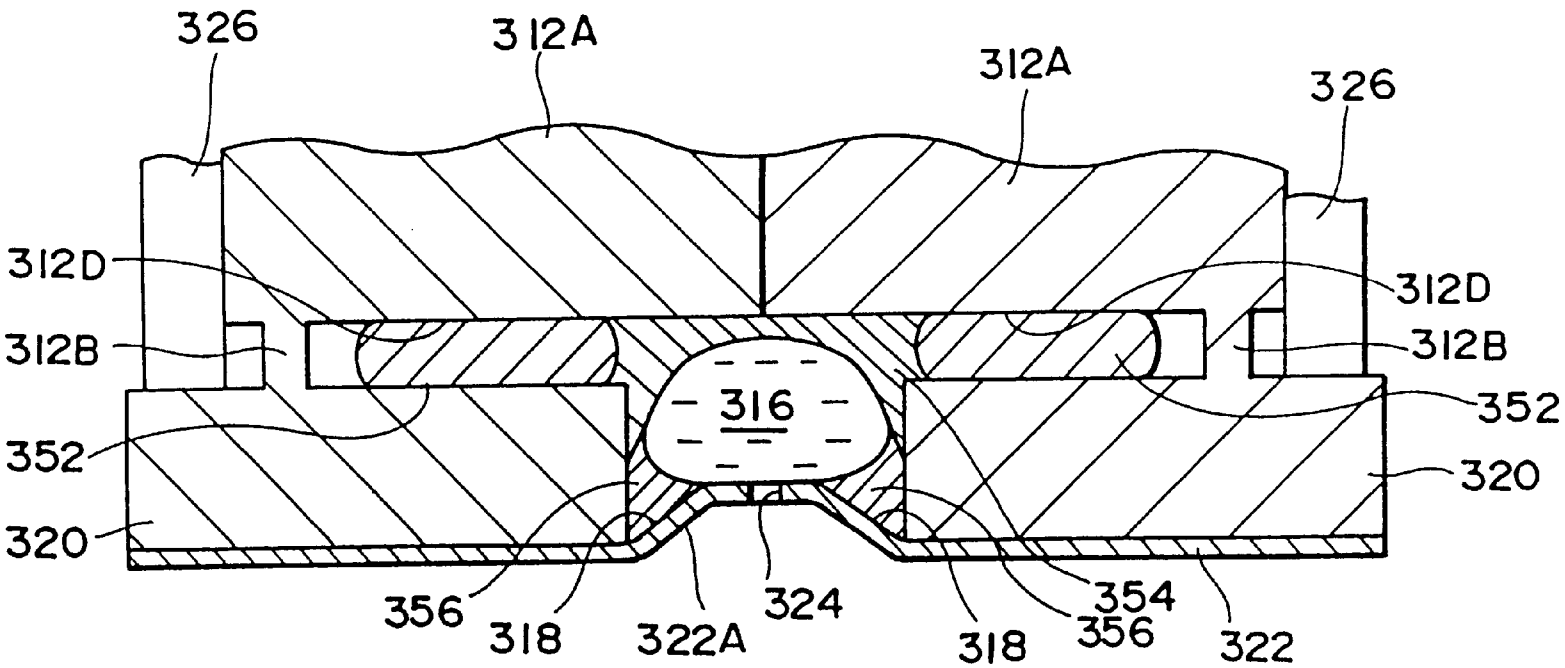
FIG. 15 is an enlarged cross sectional view which shows a main portion of the injecting tank in accordance with the second embodiment of the present invention.

Further, as shown in FIG. 15 showing the main portion of the injecting tank 312 in an enlarged manner, the space defined by the bottom surfaces of the pair of tank bodies constituting materials 312A, the front end surfaces of the pair of lever plates 320 and the upper surfaces of the nozzle plates 322 and having a substantially rectangular cross sectional shape is formed within the injecting tank 312 and between the front end portions of the pair of lever plates 320, and a solvent storing space 316 for storing the water is disposed within the space.

Then, the space is filled with the elastic member 354 (for example, the silicon adhesive) constituted by the silicon rubber in such a manner as to draw a smooth free curve with no unevenness, and the sealing performance around the swing groove portion 312D can be secured by the elastic member 354.

Further, a pair of recess portions 318 respectively constituting a part of the solvent storing space 316 are formed between the front end surface of the pair of lever plates 320 and the portion projecting upward in FIG. 15 by the groove portion 322A formed on the nozzle plate 322.

The surface adhesive 356 (for example, a thermoplastic sheet adhesive) for bonding between the lever plate 320 and the nozzle plate 322 with no gap is filled within the recess portion 318 in such a manner as to slightly project from the recess portion 318, and the surface adhesive 356 and the elastic member 354 form the inner wall surface of the solvent storing space 316 for storing the water by the smoothly curved surface.

Accordingly, the filling material is constituted by the elastically deforming elastic members 352 and 354 and the surface adhesive 356, so that the elastic material and the plastic material are filled within the swing groove portion 312D and the solvent storing space 316. Then, since the cross sectional shape shown in FIG. 13 of the solvent storing space 316 for storing the water in the injecting tank 312 is close to a smoothly curved circular tube shape, the bubbles do not tend to adhere to the inner portion of the injecting tank 312.

On the other hand, the uniform and large amplitude of the nozzle plate 322 can be obtained along the direction in which the plurality of nozzle holes 324 are linearly disposed by the small number of piezoelectric elements 326, as mentioned above. Accordingly, the amplitude can be made such that the amplitude distribution along the width direction of the photosensitive material 16 is uniform and the water pressure of the peripheral portion of each of the nozzle holes 324 reaches the pressure in which the atomization can be performed. As a result of this, it is possible to inject and atomize the water all around the width direction of the photosensitive material 16 from the plurality of nozzle holes 324 in a substantially uniform manner.

Next, an assembling of the injecting tank 312 in accordance with the present embodiment will be described below.

Figures 16A, 16B, 16C:
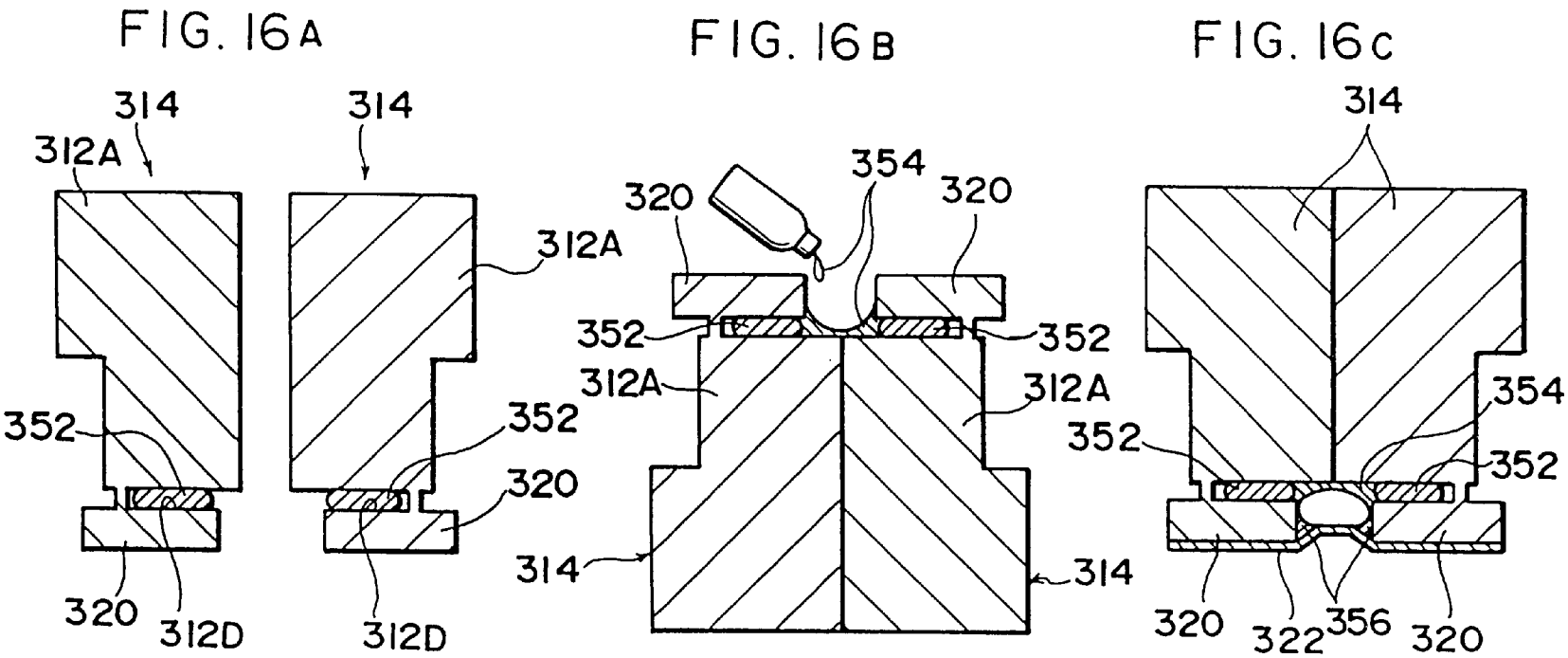

At first, the pair of symmetrical frames 314 are respectively formed by the extrusion molding of the aluminum as shown in FIG. 16A.

The elastic member 352 is filled in the swing groove portion 312D between the lever plate 320 and the tank body constituting member 312A in a state that these frames 314 are in a single unit. In this case, since the elastic member 353 has non-fluidity in an initial state, the elastic member 352 does not flow out from the swing groove portion 312D in an unprepared manner and hardens in about five minutes.

Further, the pair of frames 314 are fastened by the bolt (not shown) and are connected as shown in FIG. 16B, and in a state that the pair of frames 314 are inverted, the elastic member 354 having an initial viscosity of 2.5 Pa s and a hardening time of about five minutes is filled within the space between the pair of lever plates 320.

Due to the initial flow of the elastic member 354, the inner wall surface of the solvent storing space 316 is formed in the upper portion of the pair of tank body constituting member 312A in such a manner as to draw a smooth free curve with no unevenness, thereby securing the sealing performance around the swing groove portion 312D.

Thereafter, as shown in FIG. 16C, the nozzle plate 322 is bonded and mounted to the lever plate 320 of the frame 314, and at this time, in a state of disposing the thermoplastic surface adhesive 356 for adhering between the lever plate 320 and the nozzle plate 322 in such a manner as to intentionally project from the recess portion 318, these are heated and adhered.

Then, finally, the seal plate 328, the piezoelectric element 326 and the like are mounted so that the assembly of the injecting tank 312 is completed.

Next, an operation of the present invention will be described below.

As in the same manner as that in the first embodiment, when the development of the photosensitive material 16 taken out from the sensitive material magazine 14 by the nip roller 18 is completed, the developed photosensitive material 16 is fed to the water application portion 50. In the water application portion 50, the transferred photosensitive material 16 is fed to the injecting tank 312 by the operation of the transfer roller 32.

Then, the water is applied to the photosensitive material 16 transferred along the transfer path D by the injection of the injecting tank 312, and the motion and operation at this time will be described below.

The injecting tank 312 storing the water is disposed in the upper portion of the transfer path D in such a manner as to oppose the transfer path D of the photosensitive material 16. Then, the nozzle plate 322 in which the plurality of nozzle holes 324 injecting the water are lineally disposed is provided in the injecting tank 312 for the bottom wall surface of the injecting tank 312 opposing the transfer path D of the photosensitive material 16.

Further, the pair of narrow lever plates 320 are respectively connected to both the end portions of the nozzle plate 322 disposed in the direction perpendicular to the direction in which the plurality of nozzle holes 324 are linearly disposed, and these pair of lever plates 320 are supported to the pair of supporting portions 312B extending along the direction in which the plurality of nozzle holes 324 are linearly disposed in such a manner as to be swung.

Before the water is injected by the injecting tank 312, at first the valve of the exhaust tube 330 is made in a closed state by the controller. At a time of atomizing and injecting the water in this state, the voltage is applied to the piezoelectric element 326 by making contact from the power source controlled by the controller, so that all the piezoelectric elements 326 are extended and distorted at the same time.

Figure 14:
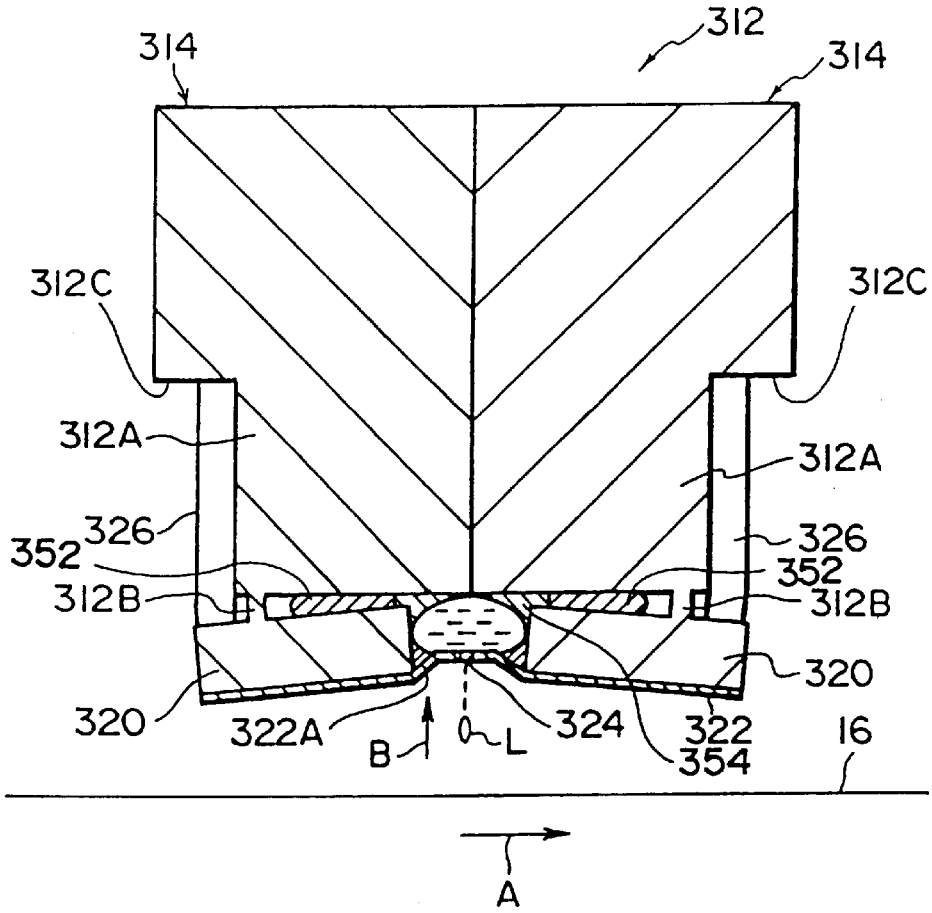
FIG. 14 is a cross sectional view showing a state in which water is injected from the injecting tank in accordance with the second embodiment of the present invention.

When the plurality of piezoelectric elements 326 are stretched and compressed at the same time, because the pair of lever plates 320 are respectively swung around the supporting portion 312B, the portion of the nozzle plate 322 in the periphery of the nozzle holes 324 positioned in a state of being held between the pair of lever plates 320 is oscillated along the direction toward the photosensitive material 16 on the transfer path D (in this case, is moved to the direction shown in the arrow B in FIG. 14), so that the nozzle plate 322 pressurizes the water within the solvent storing space 316 of the injecting tank 312.

As mentioned above, in correspondence to the operation of the piezoelectric element 326, the water filled within the solvent storing space 316 of the injecting tank 312 is injected from the plurality of nozzle holes 324. As a result of this, the water filled in the injecting tank 312 is injected and atomized from the nozzle holes 324 as shown in FIG. 14, so as to be attached on the photosensitive material 16 while being transferred.

At this time, the elastic material 352 filled in the portion between the lower wall surface of the pair of tank body constituting members 312A and the pair of lever plates 320 is elastically distorted at a time of swinging around the supporting portion 312B of the pair of lever plates 320 so as not to disturb the swing motion. Then, the elastic member 354 fills the space between the wall surface of the tank body constituting member 312A and the pair of lever plates 320, and the elastic member 354 and the surface adhesive 356 makes the inner wall surface of the solvent storing space 316 the smoothly curved wall surface.

In the above case, in accordance with the injection of the water, the bubbles sometimes enter the injecting tank 312 from the nozzle holes 324. However, since the inner wall surface of the solvent storing space 316 of the injecting tank 312 is made into a gently curved wall surface by the elastic member 354 and the surface adhesive 356, the bubbles do not adhere to the inner wall surface of the solvent storing space 316 and accumulate, but ascend within the injecting tank 312 and are discharged from the injecting tank 312 via the exhaust tube 330.

Accordingly, since the pressure loss together with the compression of the bubbles is not generated during the atomizing operation in the injecting tank 312, deterioration in atomization due to water not leaving from nozzle holes 324 does not occur, so that portions where water does not adhere do not arise on the photosensitive material 16.

In other words, as a result of this, the water can be uniformly applied onto the upper surface of the photosensitive material 16 by the injecting tank 312 which is not in contact with the photosensitive material 16.

Figure 17:
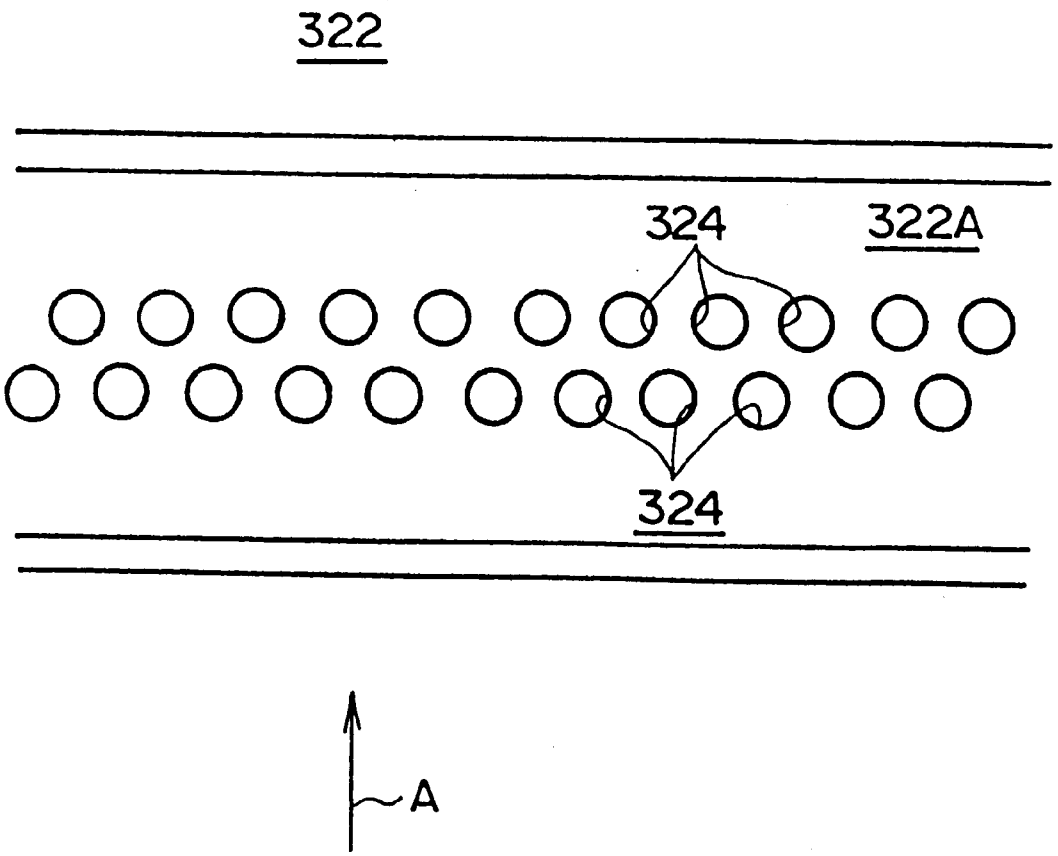
FIG. 17 is an enlarged schematic view which shows a main portion of a disposition of nozzle holes in an injecting tank in accordance with a third embodiment of the present invention.

Next, an enlarged view of the nozzle plate 322 of the injecting tank 312 in accordance with a third embodiment of the present invention is shown in FIG. 17 and an explanation thereof will be given below. In this case, the same reference numerals are attached to the same element as those in the first and second embodiments, and the explanation thereof will be omitted.

As shown in FIG. 17, the plurality of nozzle holes 324 injecting the water are disposed in the nozzle plate 322 of the injecting tank 312 in accordance with the present embodiment so that two rows of nozzles linearly disposed along the direction crossing the transfer direction A of the photosensitive material 16 at a constant interval are disposed in a zigzag manner.

Since the nozzle holes 324 are disposed in the above manner, not only are the same functions and effects as those of the first and second embodiments obtained. The application for two rows can also be performed with a single injection, so that the number of times the piezoelectric elements 326 are stretched and compressed can be reduced and efficient application can be achieved.

In the above second and third embodiments, the frame 314 is made of aluminum. However, it may be made of other metal materials such as brass, magnesium and the like. Further, the elastic member 352 and the elastic member 354 are not limited to the material shown in the embodiment. Other materials having elasticity, for example, rubber materials and the like may be employed. Still further, with respect to the surface adhesive 356, as far as the function is satisfied, other materials may be employed. For example, a silicon rubber material may be employed in the same manner as the elastic members 352 and 354.

Figure 18:
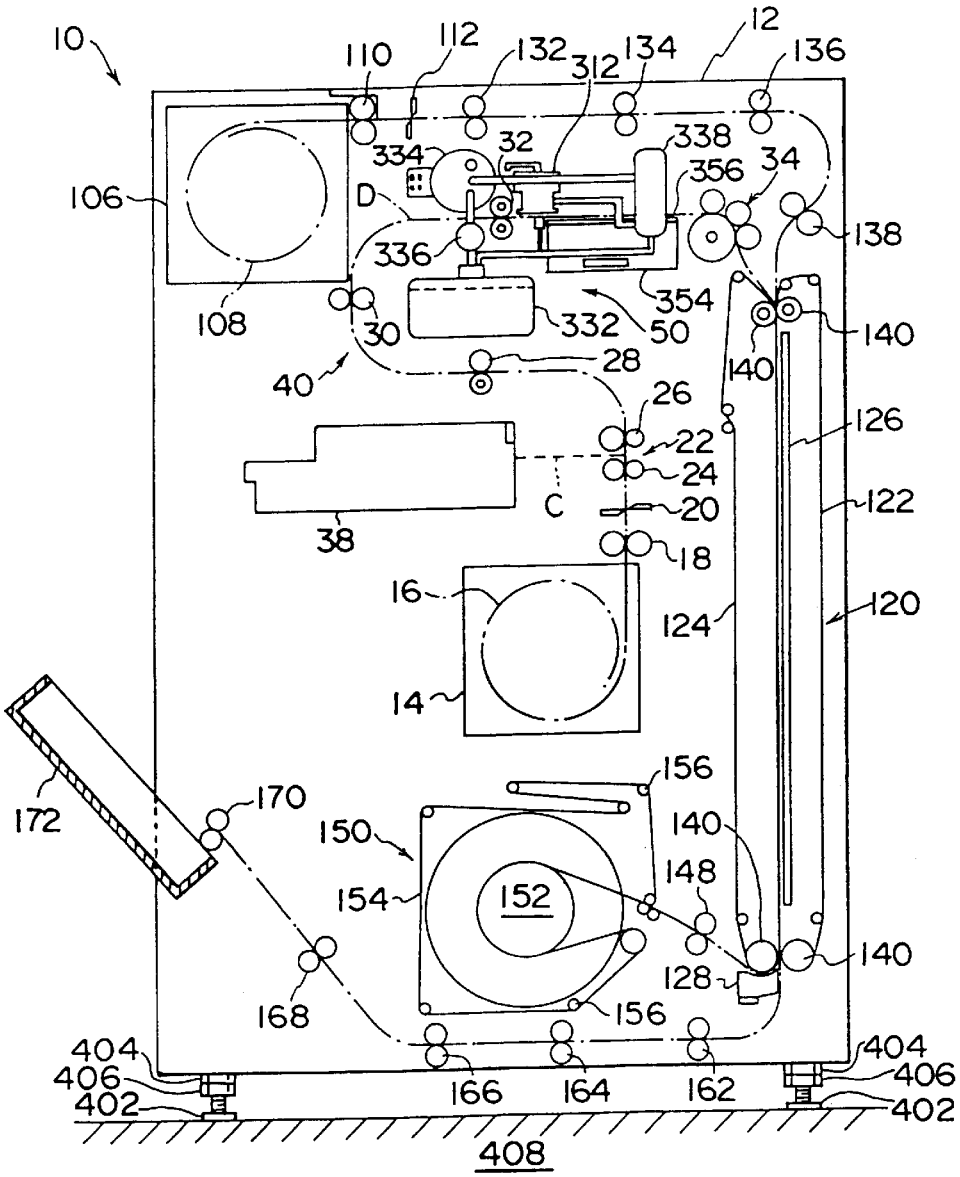
FIG. 18 is a schematic view of a total structure of an image recording apparatus relating to a fourth embodiment of the present invention.

Next, a schematic view of the total structure of an image recording apparatus 10 which is an image forming apparatus relating to a fourth embodiment of the present invention is shown in FIG. 18, and an explanation thereof will be given below. Members which are the same as those explained in the first embodiment are denoted by the same reference numerals, and repetitive explanations thereof are omitted.

As shown in FIG. 18, each of four leg portions 402 (FIG. 18 shows only two of them), in which a male screw is formed at the outer circumferential side, is screwed to a lower portion of a machine casing 12 of the image recording apparatus 10. Further, a nut 404 and a nut 406 are screwed to this leg portion 402. The nut 404 is screwed to the lower surface of the machine casing 12 in an abutment state and the nut 406 for preventing a slack is screwed to the lower surface of the nut 404.

Accordingly, when the image recording apparatus 10 is provided on a floor surface 408 for operation, amounts of the leg portions 402 to be screwed to the machine casing 12 are adjusted such that the conveying path D of a photosensitive material 16 which opposes an injecting tank 312 is horizontal. The nut 406 and the nut 406 are screwed to the machine casing 12 in this horizontal state and the conveying path D is kept horizontal.

Thus, water serving as an image forming solvent can be injected vertically from the injecting tank 312 of an application apparatus 310 to the photosensitive material 16 on the conveying path D in accordance with gravity and, after water droplets are applied to the photosensitive material 16, the water is deposited evenly onto the entire surface thereof. (If the conveying path D is not horizontal, after water droplets are applied to the photosensitive material 16, the water is deposited onto a part of the surface thereof.) As a result, it is possible that a swelling of water is uniform, a chemical reaction is uniform, a contamination of the image recording apparatus 10 caused by the dropping of solution from the photosensitive material 16 is prevented, a conveying failure of the photosensitive material 16 is prevented, and the like.

Figure 19:
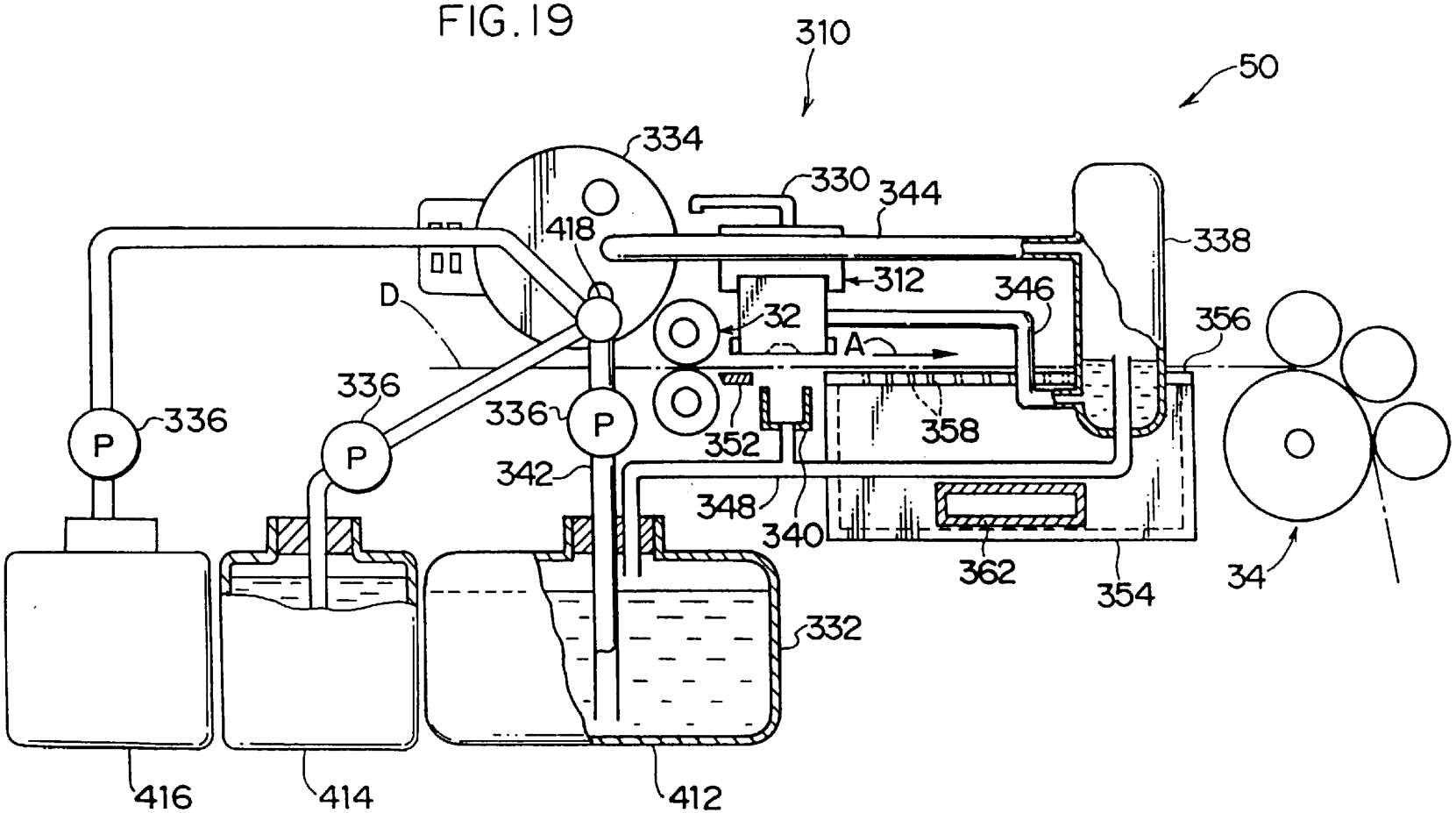
FIG. 19 is a schematic view of a total structure of an application apparatus relating to a fifth embodiment of the present invention.
Figure 20:
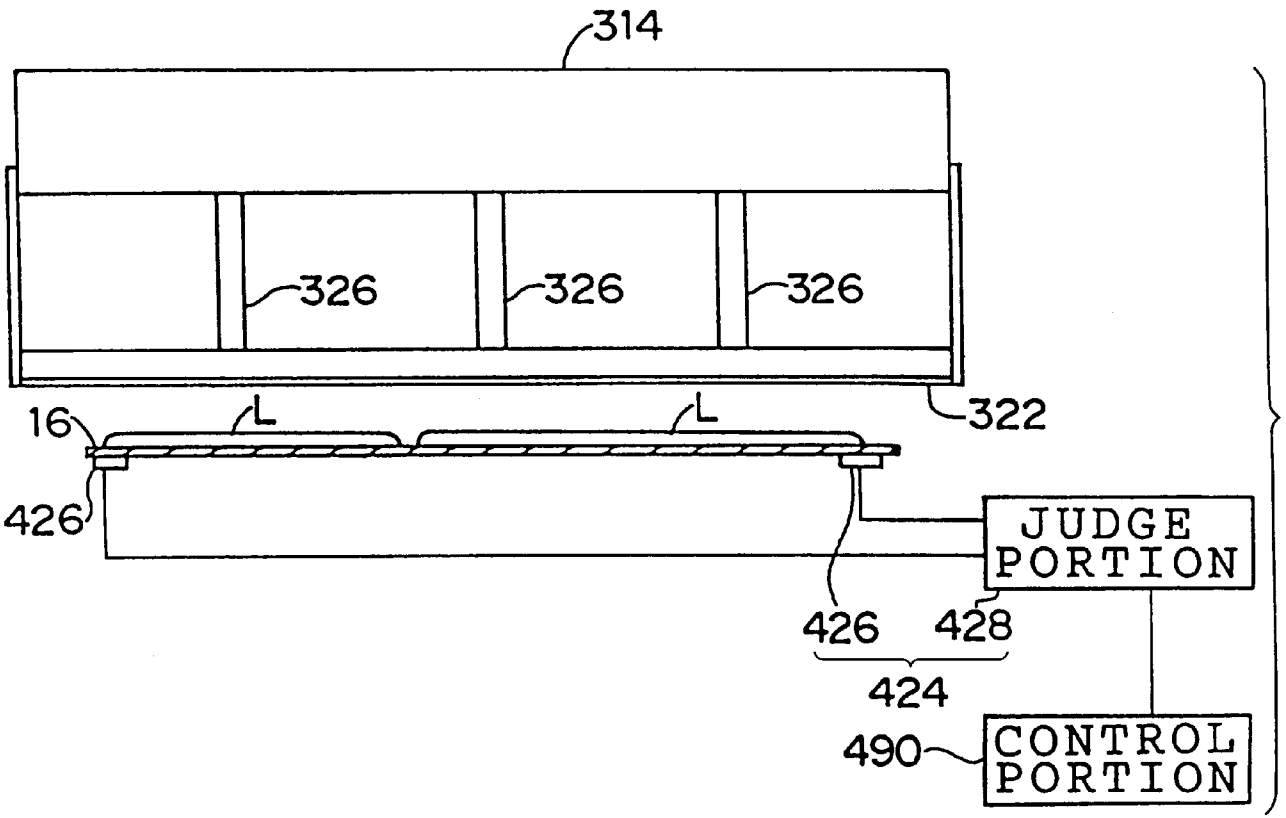
FIG. 20 is an explanatory view which explains a droplet sensor relating to the fifth embodiment of the present invention.
Figure 21:
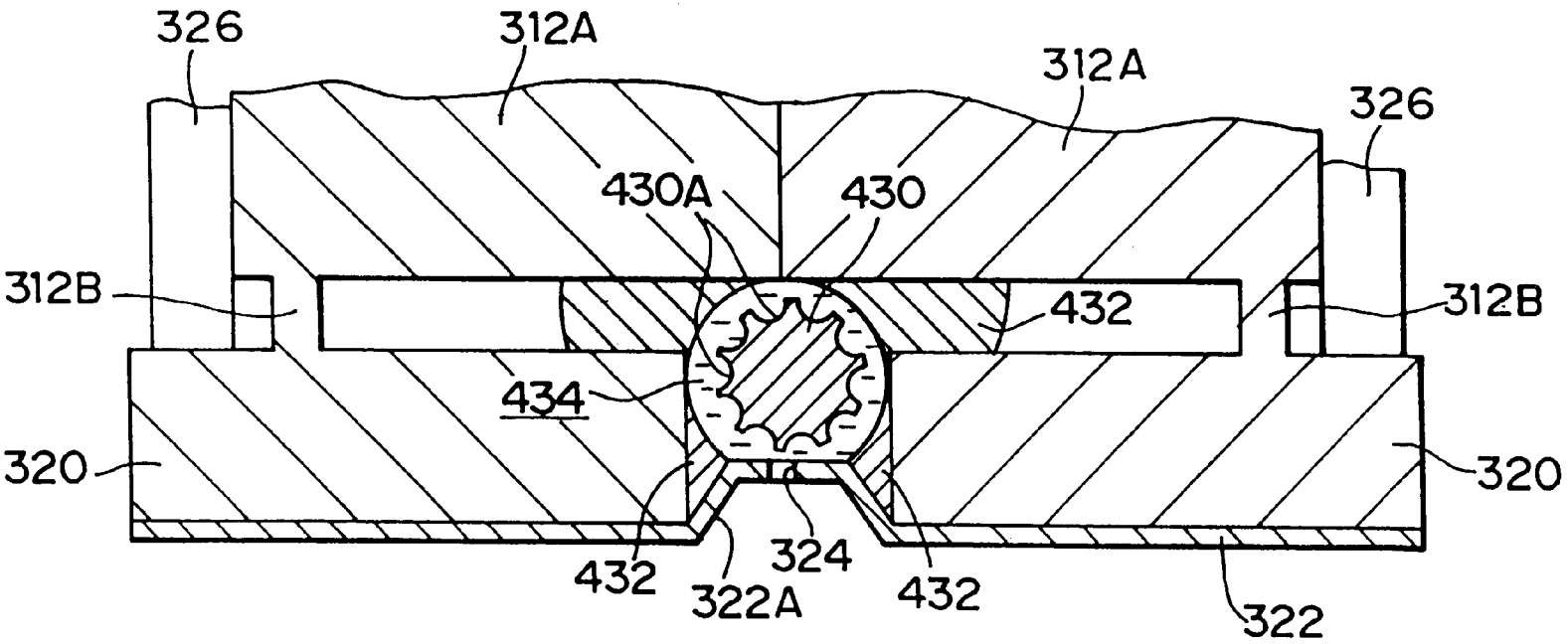
FIG. 21 is an enlarged cross-sectional view of a main portion of an injecting tank relating to the fifth embodiment of the present invention.

Next, an image forming apparatus relating to a fifth embodiment of the present invention is shown in FIGS. 19 through 21, and an explanation thereof will be given below. Members which are the same as those explained in the first embodiment are denoted by the same reference numerals, and repetitive explanations thereof are omitted.

FIG. 19 shows the application apparatus 310 of the image recording apparatus 10 which is the image forming apparatus relating to the fifth embodiment.

As shown in FIG. 19, in the fifth embodiment, there are three tanks formed by a processing solution tank 412, a washing solution tank 414, and a water tank 416. The passages from these three tanks to the injecting tank 312 can be switched by a switching valve 418. Further, this switching valve 418 is connected to a controller 490 (FIG. 20) which controls the operation of the application apparatus 310.

In short, there are a plurality of supply sources to the liquid injecting tank 312, the operation of the switching valve 418 is controlled by the controller 490, and the passages from the three tanks to the injecting tank 312 can be switched. When an image forming solvent is a processing solution other than water, the processing solution tank 412 is filled with this processing solution, the washing solution tank 414 is filled with a washing solution, and the water tank 416 is filled with water.

Moreover, as shown in FIG. 20, in the fifth embodiment, a droplet sensor 424 comprises a pair of electrodes 426 and a judge portion 428. The electrodes 426 are disposed so as to contact end portions of the photosensitive material 16 which correspond to end portions of a nozzle row, and the judge portion 428 judges atomization failure by measuring a value of electrical resistance between these pair of electrodes 426. (when atomization failure occurs, the value of electrical resistance between these pair of electrodes 426 changes.) This droplet sensor 424 is connected to the controller 490. In this way, the atomization failure of the injecting tank 312 is detected by the droplet sensor 424.

On the other hand, as shown in FIG. 21, a space which is defined by a pair of side walls 312A, the distal end surfaces of a pair of lever plates 320, and the upper surfaces of nozzle plates 322 is formed in the injecting tank 312. Further, this space is filled with an elastic member 432 (e.g., a silicon adhesive) formed of a silicon rubber so as to form a gentle free curve without bumps or indentations, and the inner wall surface of a solvent storing space 434 for storing water is formed in a gently curved circular tube configuration by this elastic member 432.

Moreover, a bubble discharging member 430, in which cylindrical and arc-shaped concave portions 430A are provided on the outer peripheral surface at equal intervals, is disposed within the solvent storing space 434 of the injecting tank 312. The cross-sectional surface area of the solvent storing space 434 having a substantially circular cross section within the injecting tank 312 is thereby made small. Accordingly, even if bubbles enter the injecting tank 312 due to entering of the processing solution from one end of the injecting tank 312, the flow rate of the processing solution within the solvent storing space 434 is increased by the bubble discharging member 430 and it is difficult for the bubbles to remain within the injecting tank 312.

As described above, since it is difficult for the bubbles to remain within the injecting tank 312 by the bubble discharging member 430, the processing solution is reliably ejected from respective nozzle holes 324. Further, even if one of the nozzle holes 324 is clogged with the processing solution or the like and the processing solution L is not ejected, as shown in FIG. 20, the processing solution L on the photosensitive material 16 is broken off and atomization failure is detected by the droplet sensor 424. Due to the detection by this droplet sensor 424, the controller 490 operates the switching valve 418 shown in FIG. 19 and the passages from the three tanks 412, 414, 416 to the injecting tank 312 are switched. Consequently, the washing solution and the water for solving the clogging of the nozzle hole 324 caused by the processing solution or the like can be supplied in that order.

Figure 22:
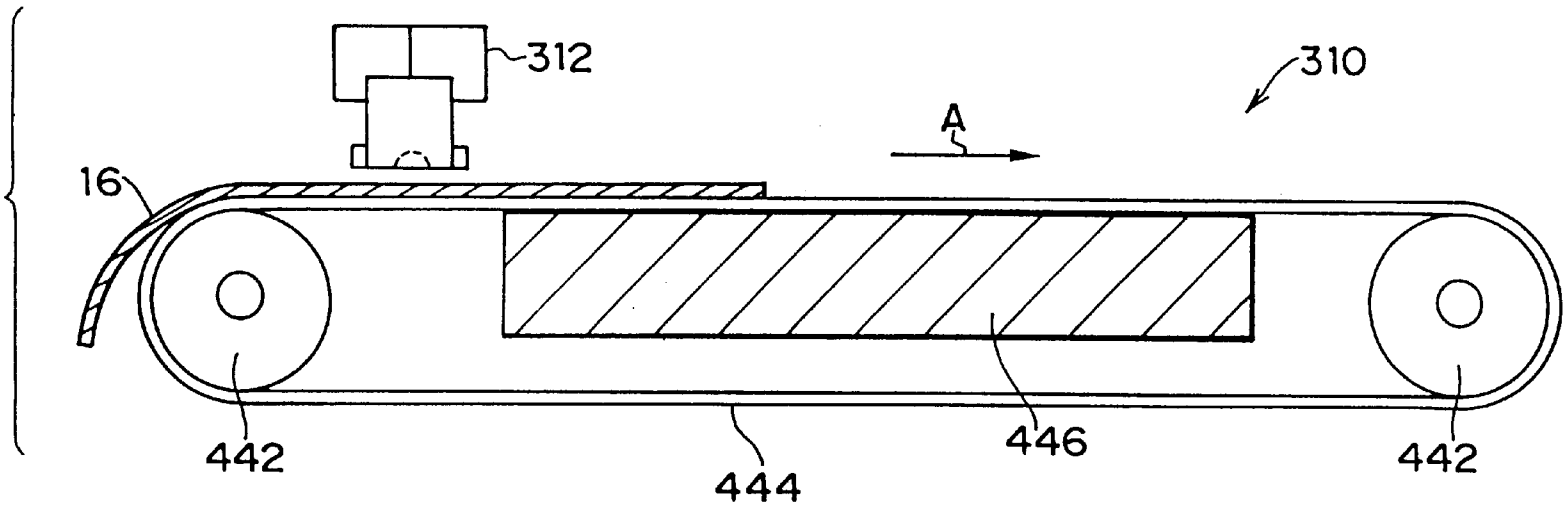
FIG. 22 is a diagram which shows a conveying system of an application apparatus relating to a sixth embodiment of the present invention.

Next, a conveying system of the application apparatus 310 of the image recording apparatus 10 which is an image forming apparatus relating to a sixth embodiment of the present invention is shown in FIG. 22, and an explanation thereof will be given below. Members which are the same as those explained in the first embodiment are denoted by the same reference numerals, and repetitive explanations thereof are omitted.

As shown in FIG. 22, a conveying belt 444, which is a conveying member and is wound around a pair of drive rollers 442, is disposed on the opposite side of the conveying path of the photosensitive material 16 provided beneath the injecting tank 312 of the application apparatus 310 with respect to the injecting tank 312. One of the pair of drive rollers 442 is connected to a drive source such as a motor or the like. As a result, the conveying belt 444 rotates due to the rotation of the drive source.

Further, a gel-typed material having adhesiveness is applied to the outer peripheral surface of this conveying belt 444 so that the photosensitive material 16 can be adhered temporarily to but peeled from the conveying belt 444. Moreover, a heating plate 446 for heating the photosensitive material 16 via the conveying belt 444 is disposed between the pair of drive rollers 442 and at a position on the conveying direction downstream side of the photosensitive material 16 with respect to the injecting tank 312.

Accordingly, when the photosensitive material 16 is conveyed from a photosensitive material magazine 14, the photosensitive material 16 is disposed on the conveying belt 444 in a state in which a reverse surface of the photosensitive material 16 which is opposite a photosensitive surface thereof contacts the conveying belt 444, and water is applied from the injecting tank 312 onto the photosensitive surface of the photosensitive material 16 in a state in which the photosensitive material 16 is disposed on the conveying belt 444. Thereafter, since the conveying belt 444 is moved due to the rotation of the drive rollers 442, this photosensitive material 16 is conveyed while the application surface, to which the water has been applied and which is the photosensitive surface of the photosensitive material 16, is kept in a non-contact state.

In short, the application surface is kept in the non-contact state for a predetermined period of time by this conveying belt 444. As a result, the length in which the application surface of the photosensitive material 16 is conveyed in the non-contact state can be increased, and accordingly, an area in which the application surface, to which the water has been applied, is heated in the non-contact state can be increased.

Further, because the gel-typed material having adhesiveness is applied to the outer circumferential surface of this conveying belt 444, it is difficult for the photosensitive material 16 to be deviated from the conveying belt 444 and reliability at the time of conveying the photosensitive material 16 is high.

In the sixth embodiment, a description is given of a case in which the sheet-typed photosensitive material 16 is used. However, a roll-typed photosensitive material can be processed as well as the sheet-typed photosensitive material 16. Moreover, since the heating plate 446 is used, the photosensitive material 16 is heated appropriately and the temperature thereof can be controlled. However, instead of the heating plate 446, the photosensitive material 16 may be heated by a heat roller or by atmosphere in which the temperature of the entire surrounding atmosphere is increased.

Figure 23:
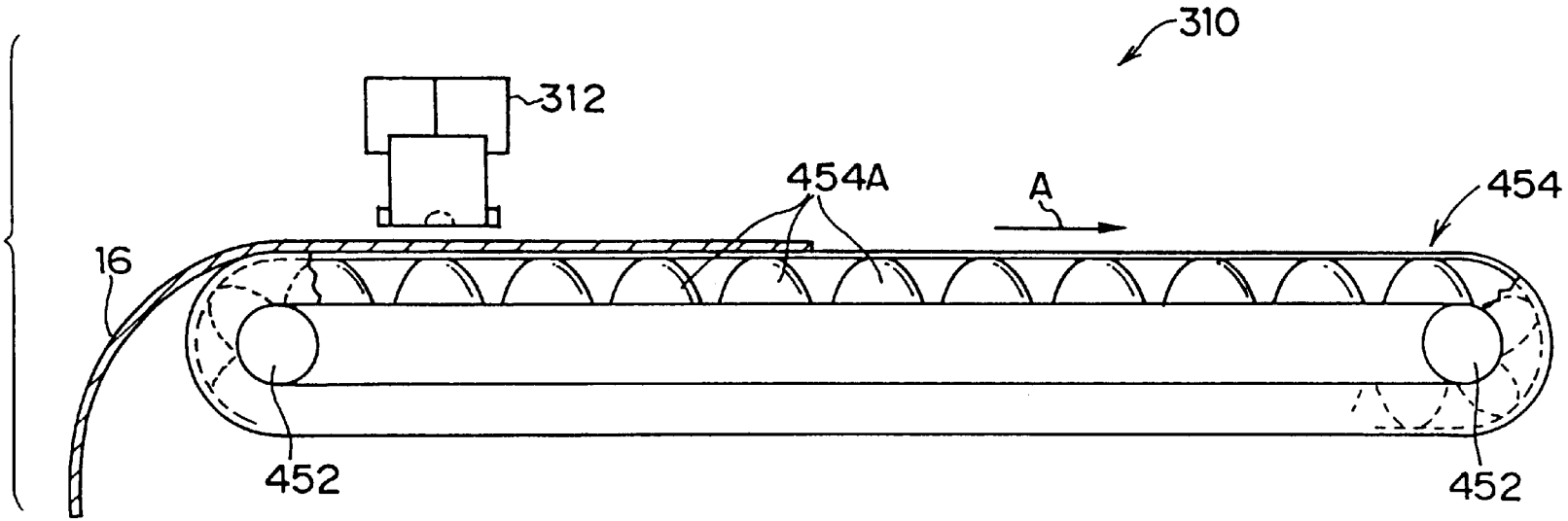
FIG. 23 is a diagram which shows a conveying system of an application apparatus relating to a seventh embodiment of the present invention.

Next, an image forming apparatus relating to a seventh embodiment of the present invention is shown in FIG. 23, and an explanation thereof will be given below. Members which are the same as those explained in the first embodiment are denoted by the same reference numerals, and repetitive explanations thereof are omitted.

As shown in FIG. 23, a conveying belt 454, which is a conveying member and is wound around a pair of drive rollers 452, is disposed on the opposite side of the conveying path of the photosensitive material 16 which is provided below the injecting tank 312 of the application apparatus 310 with respect to the injecting tank 312. One of the pair of drive rollers 452 is connected to a drive source such as a motor or the like.

This conveying belt 454 is formed so that suction pads 454A, which can suck the photosensitive material 16 at respective negative pressures or the like, are arranged in a belt shape. In a state in which the photosensitive material 16 is disposed on the group of suction pads 454A, the group of suction pads 454A are moved by the pair of drive rollers 452 and the photosensitive material 16 is conveyed.

As described above, since each of the suction pads 454A sucks the photosensitive material 16, it is difficult for the photosensitive material 16 to be deviated from the conveying belt 454 and reliability at the time of conveying the photosensitive material 16 is high.

Figure 24:
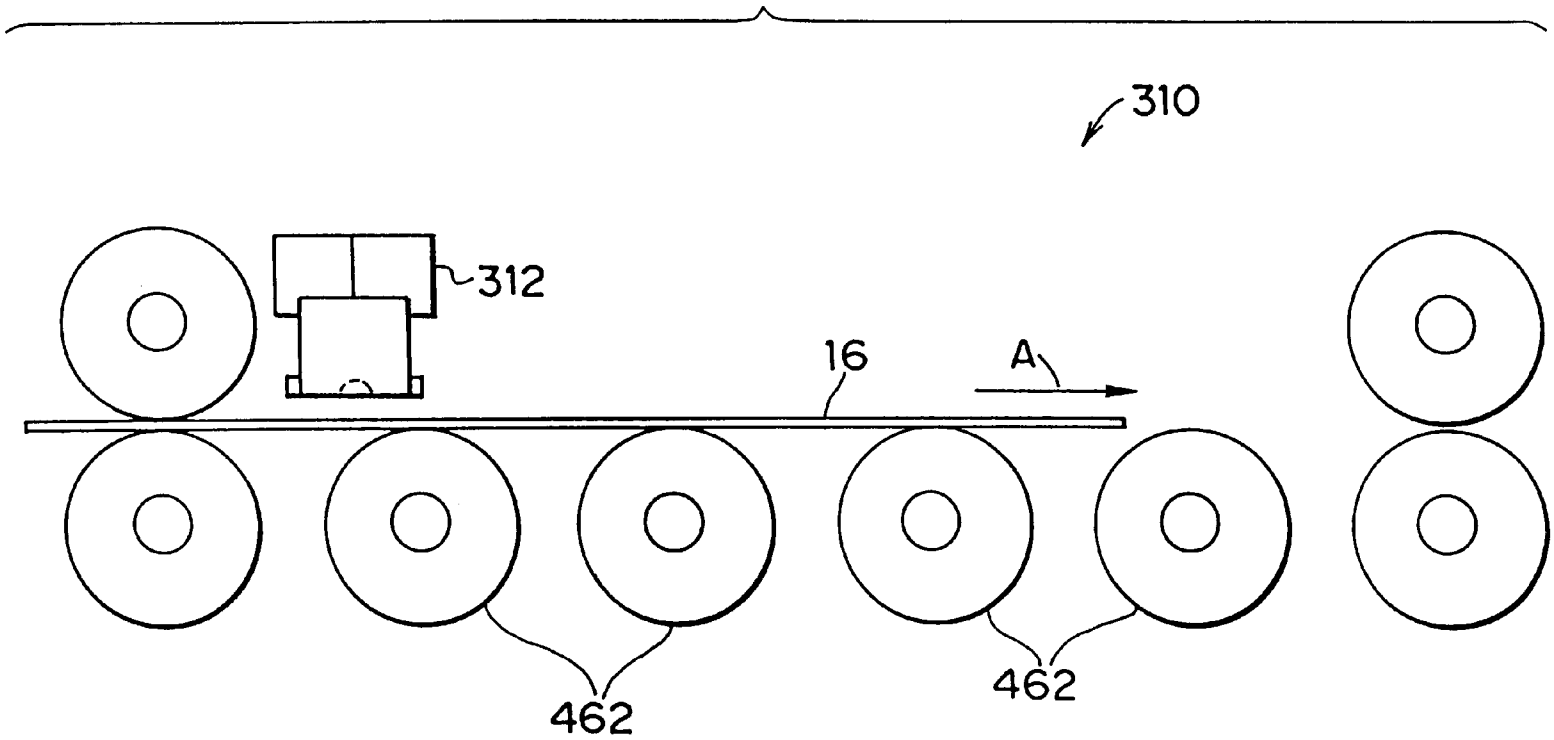
FIG. 24 is a diagram which shows a conveying system of an application apparatus relating to an eighth embodiment of the present invention.

Next, an image forming apparatus relating to an eighth embodiment of the present invention is shown in FIG. 24, and an explanation thereof will be given below. Members which are the same as those explained in the first embodiment are denoted by the same reference numerals, and repetitive explanations thereof are omitted.

In the eighth embodiment, as shown in FIG. 24, a plurality of conveying rollers 462, which are conveying members, are disposed on the opposite side of the conveying path of the photosensitive material 16 which is provided below the injecting tank 312 of the application apparatus 310 with respect to the injecting tank 312. As a result, the photosensitive material 16 can be reliably conveyed and reliability at the time of conveying the photosensitive material 16 is higher.

Figure 25:
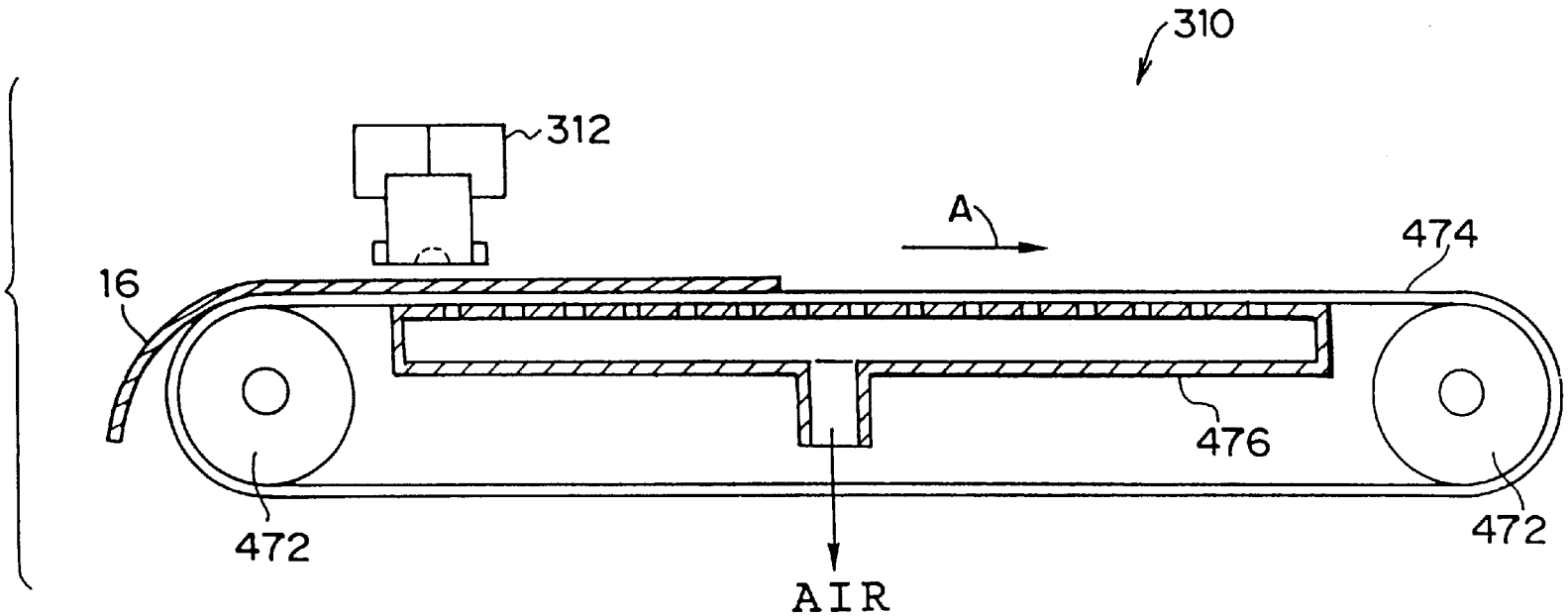
FIG. 25 is a diagram which shows a conveying system of an application apparatus relating to a ninth embodiment of the present invention.

Next, an image forming apparatus relating to a ninth embodiment of the present invention is shown in FIG. 25, and an explanation thereof will be given below. Members which are the same as those explained in the first embodiment are denoted by the same reference numerals, and repetitive explanations thereof are omitted.

As shown in FIG. 25, a conveying belt 474, which is a conveying member and is wound around a pair of drive rollers 472, is disposed on the opposite side of the conveying path of the photosensitive material 16 which is provided below the injecting tank 312 of the application apparatus 310 with respect to the injecting tank 312. One of the pair of drive rollers 472 is connected to a drive source such as a motor or the like.

Moreover, a number of unillustrated through-holes are formed over the entire surface of this conveying belt 474. A chamber 476 is disposed between these pair of drive rollers 472, and a plurality of suction holes for sucking the photosensitive material 16 at negative pressure via the through-holes of the conveying belt 474 are provided on the upper surface of the chamber 476.

As described above, since the chamber 476 sucks the photosensitive material 16 via the through-holes of the conveying belt 474, it is difficult for the photosensitive material 16 to be deviated form the conveying belt 474 and reliability at the time of conveying the photosensitive material 16 is high.

In the above three embodiments, the nozzle row is set as a single row or two rows. However, the nozzle row is not limited to just a single row or a double row. Three or more rows may be employed. By increasing the number of nozzle rows, the driving number of the actuator can be further reduced.

Further, in the above three embodiments, the nozzle row is disposed at a right angle to the transfer direction. However, it is not limited to a right angle. The nozzle row may be disposed at an angle with respect to the transfer direction.

Still further, in the above embodiments, it is structured such that the photosensitive material 16 and the image receiving material 108 are used for the image recording material and water is applied to the developed photosensitive material 16 by the injecting tank 312 of the application apparatus 310, so that the photosensitive material 16 and the image receiving material 108 are overlapped and thermally developed and transferred. However, the structure is not limited to this, and water may be injected and applied to the image receiving material 108.

Furthermore, the material is not limited to these, and the other sheet or roll image recording materials may be suitably used. Materials other than water may be used as the image forming solvent. Moreover, the invention may be used in the application of developing fluid a printing paper in a developing machine, in the application of soaking water of a printer, and in coating machines and the like.

As mentioned above, the image forming apparatus of the present invention has an excellent effect of uniformly applying the image forming solvent to the image recording material and of improving the image quality of the image on the image recording material.

Further, as mentioned above, the fluid injecting apparatus in accordance with the present invention has an excellent effect of uniformly applying the image forming solvent to the image recording material.

What is claimed is:

1. An image forming apparatus, comprising:

an injector which is disposed so as to oppose a conveying path of an image recording material and injects an image forming solvent onto the image recording material; and a guide member having suction holes for suction, disposed on an opposite side of the conveying path with respect to said injector, and guiding the image recording material through suction by the suction holes;

wherein said guide member includes a conveying belt provided with a plurality of through-holes and suction means for sucking the image recording material on the conveying belt via the through-holes.

2. An image forming apparatus according to claim 1, further comprising:

horizontal state adjusting means for adjusting the conveying path to be horizontal.

3. An image forming apparatus according to claim 1, further comprising:

liquid storing means for storing liquids which are supplied to said injector, wherein said liquid storing means includes a plurality of liquid storing tanks, and at least one of the liquid storing tanks is a liquid storing tank for storing any one of water, the image forming solvent, and a washing solution for washing nozzle holes disposed at said injector.

4. An image forming apparatus according to claim 1, further comprising:

liquid storing means for storing liquids which are supplied to said injector, wherein said liquid storing means includes liquid storing tanks for storing water, the image forming solvent, and a washing solution for washing nozzle holes disposed at said injector.

5. An image forming apparatus according to claim 1, further comprising:

injection abnormality detection means which detects an injection abnormality of said injector.

6. An image forming apparatus according to claim 5, wherein said injection abnormality detection means detects the injection abnormality of said injector on a basis of a change of a value of resistance caused by the injection abnormality of said injector.

7. An image forming apparatus according to claim 4, further comprising:

injection abnormality detection means which detects an injection abnormality of said injector.

8. An image forming apparatus according to claim 7, further comprising:

switching means which switches passages from the liquid storing tanks to said injector; and control means which controls said switching means, wherein when the injection abnormality of said injector has been detected by said injection abnormality detection means, said control means controls said switching means so as to switch the passages.

9. An image forming apparatus according to claim 8, wherein when the injection abnormality of said injector has been detected by said injection abnormality detection means, said control means controls said switching means such that a passage from the tank storing the image forming solvent to said injector is switched to a passage from the tank storing the washing solution to said injector and that nozzle holes disposed on said injector are washed.

10. An image forming apparatus according to claim 1, further comprising:

bubble discharging means which is disposed within an injecting tank for storing a liquid in said injector and which makes it difficult for bubbles to remain in the injecting tank.

11. An image forming apparatus according to claim 10, wherein said bubble discharging means is formed and disposed so as to make a cross sectional surface area of the injecting tank small.

12. An image forming apparatus, comprising:

an injector which is disposed so as to oppose a conveying path of an image recording material and injects an image forming solvent onto the image recording material; and a guide member having applied an adhesive material thereto, disposed on an opposite side of the conveying path with respect to said injector, and guiding the image recording material.

13. An image forming apparatus according to claim 12, wherein the guide member comprises:

a conveying belt which conveys the image recording material and to which the adhesive material is applied; and a drive roller for moving the conveying belt.

14. An image forming apparatus according to claim 13, wherein the adhesive material is a material which can temporarily hold the image recording material on the conveying belt by an adhesion force of the adhesive material such that the image recording material can be peeled from the conveying belt.

15. An image forming apparatus according to claim 13, wherein the adhesive material is a gel-type material and the gel-type material is applied to an outer circumferential surface of the conveying belt.

16. An image forming apparatus, comprising:

an injector which is disposed so as to oppose a conveying path of an image recording material and injects an image forming solvent onto the image recording material; and a guide member, disposed on an opposite side of the conveying path with respect to said injector, and guiding the image recording material;

wherein said guide member includes a plurality of suction members form suction of the image recording material.

17. An image forming apparatus according to claim 16, wherein the guide member comprises:

a belt shaped member formed by the plurality of suction members, which sucks the image recording material thereto, the member being arranged in a belt-shape; and a drive roller for moving the belt shaped member.

18. An image forming apparatus according to claim 17, wherein each of the suction members is a suction pad which sucks the image recording material by a negative pressure.

19. An image forming apparatus, comprising:

an injector which is disposed so as to oppose a conveying path of an image recording material and injects an image forming solvent onto the image recording material; and a guide member, disposed on an opposite side of the conveying path with respect to said injector, and guiding the image recording material, wherein said guide member is a plurality of conveying rollers.

* * * * *